US010575113B2

(12) United States Patent
Badler et al.

(10) Patent No.: US 10,575,113 B2
(45) Date of Patent: Feb. 25, 2020

(54) SOUND PROPAGATION AND PERCEPTION FOR AUTONOMOUS AGENTS IN DYNAMIC ENVIRONMENTS

(71) Applicant: The Trustees of The University of Pennsylvania, Philadelphia, PA (US)

(72) Inventors: Norman I. Badler, Haverford, PA (US); Pengfei Huang, Bellevue, WA (US); Mubbasir Kapadia, Baden (CH)

(73) Assignee: The Trustees of the University of Pennsylvania, Philadelphia, PA (US)

( * ) Notice: Subject to any disclaimer, the term of this patent is extended or adjusted under 35 U.S.C. 154(b) by 0 days.

(21) Appl. No.: 15/909,054

(22) Filed: Mar. 1, 2018

(65) Prior Publication Data

US 2018/0227693 A1 Aug. 9, 2018

Related U.S. Application Data

(63) Continuation of application No. 14/904,819, filed as application No. PCT/US2014/046894 on Jul. 16, 2014, now Pat. No. 9,942,683.

(60) Provisional application No. 61/846,827, filed on Jul. 16, 2013.

(51) Int. Cl.

| | |
|---|---|
| ***H04R 5/02*** | (2006.01) |
| ***H04S 7/00*** | (2006.01) |
| ***G10L 25/18*** | (2013.01) |

(52) U.S. Cl.

CPC ..... *H04S 7/30* (2013.01); *G10L 25/18* (2013.01); *H04S 2400/11* (2013.01); *H04S 2420/07* (2013.01)

(58) Field of Classification Search

CPC .... H04S 7/30; H04S 2400/11; H04S 2420/07; G10L 25/18

See application file for complete search history.

(56) References Cited

U.S. PATENT DOCUMENTS 9,942,683 B2 * 4/2018 Badler ..... G10L 25/18
2013/0257877 A1 10/2013 Davis

OTHER PUBLICATIONS

Mubbasir, et al., "Communication in Crowd Simulation", http://glab-ccs.blogspot.com/2012/09/script-before-meeting-919.html, 2012, accessed Dec. 26, 2014, 3 pgs.

Herrero, et al., "Introducing Human-like Hearing Perception in Intelligent Virtual Agents", Scientific Journal, 2003, 733-740.

(Continued)

*Primary Examiner* — Andrew L Sniezek

(74) *Attorney, Agent, or Firm* — BakerHostetler

(57) ABSTRACT

Methods and systems for sound propagation and perception for autonomous agents in dynamic environments are described. Adaptive discretization of continuous sound signals allows one to obtain a minimal, yet sufficient sound packet representation (SPR) for human-like perception, and a hierarchical clustering scheme to facilitate approximate perception. Planar sound propagation of discretized sound signals exhibit acoustic properties such as attenuation, reflection, refraction, and diffraction, as well as multiple convoluted sound signals. Agent-based sound perceptions using hierarchical clustering analysis that accommodates natural sound degradation due to audio distortion facilitate approximate human-like perception.

20 Claims, 18 Drawing Sheets

(56) References Cited

OTHER PUBLICATIONS

Gygi, et al., "Similarity and Categorization of Environmental Sounds", Perception & Psychophysics, 2007, 69(6), 839-855.
Faure, et al., "Time-Domain Numerical Modeling of Acoustical Propagation in the Presence of Boundary Irregularities" Proceeding of the Acoustics, Apr. 2012, 3248-3254.
Drettakis, et al., "Progressive Perceptual Audio Rendering of Complex Scenes", Cross-Modal Perceptual Interaction and Rendering Newsletter No. 2, May 2007, 7 pgs.
Cowling et al., "Comparison of Techniques for Environmental Sound Recognition", Pattern Recognition Letters, 2003, 24(15), 2895-2907.

* cited by examiner

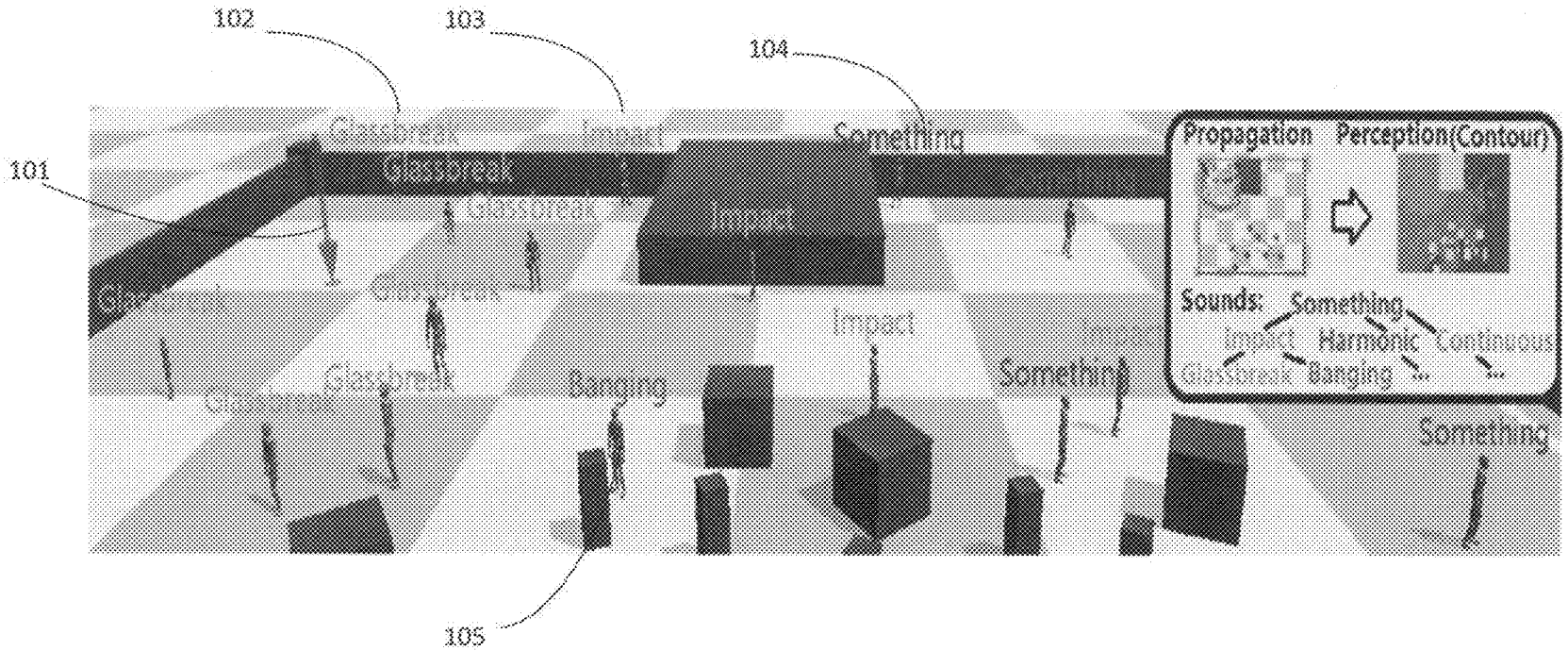
Propagation
Perception(Contour)
Sounds
Something
Harmonic
Something
Something
Something T = 1
1.0
T = 2
0.5
-0.5
-0.5
-0.5
T = 3 ...
0.25
0.25
0.25
0.25
0.25
0.25
0.25
-0.25
-0.25
-0.25
-0.25
-0.25
-0.25
0.25
0.25
0.25
0.25
0.25
0.25

SOUND PROPAGATION AND PERCEPTION FOR AUTONOMOUS AGENTS IN DYNAMIC ENVIRONMENTS

CROSS REFERENCE TO RELATED APPLICATIONS

This application is a continuation of now-allowed U.S. patent application Ser. No. 14/904,819, "Sound Propagation and Perception for Autonomous Agents in Dynamic Environments" (filed Jan. 13, 2016), which application is a National Stage Application filed under 35 U.S.C. 371 of International Application No. PCT/US2014/046894, "Sound Propagation and Perception for Autonomous Agents in Dynamic Environments" (filed Jul. 16, 2014), which international application claims priority to U.S. Provisional Patent Application No. 61/846,827, "Sound Propagation and Perception for Autonomous Agents in Dynamic Environments" (filed Jul. 16, 2013). All of the foregoing applications are incorporated herein by reference in their entireties for any and all purposes.

STATEMENT OF FEDERALLY SPONSORED RESEARCH

This invention was made with government support under Grant No. W911NF-10-2-0016, awarded by the U.S. Army Research Laboratory. The government has certain rights in the invention.

BACKGROUND

Current autonomous agent animation research models vision-based perception of agents using abstract perception queries such as line-of-sight ray casts and view cone intersections with the environment. Prior work has developed computational models for sound synthesis and propagation, with limited work that factors the perception of sound into agent behavior. In prior work, visual perception may be used for agent steering, while audio perception is uncommon.

SUMMARY

Disclosed herein are methods and systems for sound propagation and perception for autonomous agents in dynamic environments. In an embodiment, there may be adaptive discretization of continuous sound signals to obtain a minimal, yet sufficient sound packet representation (SPR) for human-like perception, and a hierarchical clustering scheme to facilitate approximate perception.

In another embodiment, there may be planar sound propagation of discretized sound signals that exhibit acoustic properties such as attenuation, reflection, refraction, and diffraction, as well as multiple convoluted sound signals.

In still another embodiment, there may be agent-based sound perceptions using hierarchical clustering analysis that accommodates natural sound degradation due to audio distortion and facilitates approximate human-like perception.

In yet another exemplary embodiment, a method is provided for integrating sound propagation and human-like perception into virtual creature simulations by discretizing a sound signal to obtain a sound packet representation for human-like perception and using hierarchical clustering analysis to model approximate human-like perception of the sound signal.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to limitations that solve any or all disadvantages noted in any part of this disclosure.

BRIEF DESCRIPTION OF THE DRAWINGS

A more detailed understanding may be had from the following description, given by way of example in conjunction with the accompanying drawings wherein:

FIG. 1 illustrates agent-based sound perception using packet representation and a propagation model;

DETAILED DESCRIPTION OF THE INVENTION

Figure 2A:
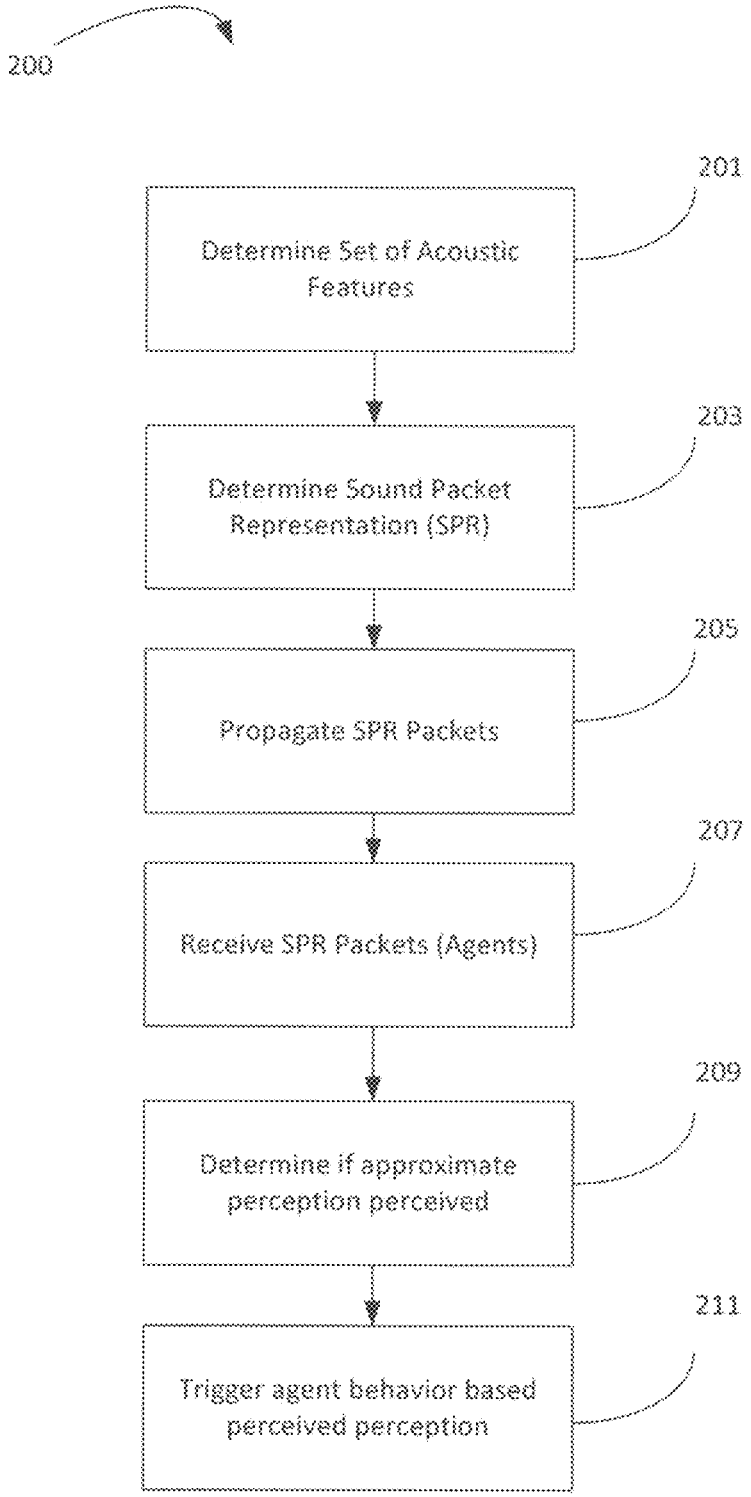
FIG. 2A illustrates an overview of a framework for sound propagation and perception for autonomous agents in dynamic environments (SPREAD) in accordance with the invention.

Conventional autonomous agent animation research models vision-based perception of agents using abstract perception queries such as line-of-sight ray casts and view cone intersections with the environment. The invention as described herein allows virtual agents to behave more human-like by using a hearing model to perceive and understand the acoustic world. Sound propagates differently from light, providing additional perceptual options for an agent, including perception and possible localization of an unseen event, and the recognition or possible misidentification of the sound type. For example, there may be an event where a person is not seen because of visual occlusion, but the person's footsteps or voice is heard.

For virtual reality and games with autonomous agents, acoustic perception may provide useful behaviors including possible goals (e.g., sound sources), avoidance regions (e.g., noisy areas), knowledge of unseen events (e.g., shots), or even navigation cues (e.g., hearing someone approaching around a blind corner). Virtual agents with 'ears' can greatly improve the realism of crowd models, games, and virtual reality systems.

Prior work has developed computational models for sound synthesis and propagation, with limited work that factors the perception of sound into agent behavior. In prior work, visual perception may be used for agent steering, while audio perception is uncommon.

The approach discussed herein regarding sound modeling, propagation and perception is illustrated in FIG. 1 and FIG. 2. FIG. 1 illustrates agent-based sound perception using packet representation and a propagation model. The arrow 101 in the scene is the sound source position, and the agents' captions on top show what they just heard. The perceptions titled "glass break" (e.g., glassbreak 102) indicates a correct perception. The indications of "impact" (e.g., impact 103) and "something" (e.g., something 104) indicate approximate perception. Indication of "banging" (e.g., banging 105) is an incorrectly perceived signal. These sound candidates or categories are from a sound cluster structure.

Figure 2B:
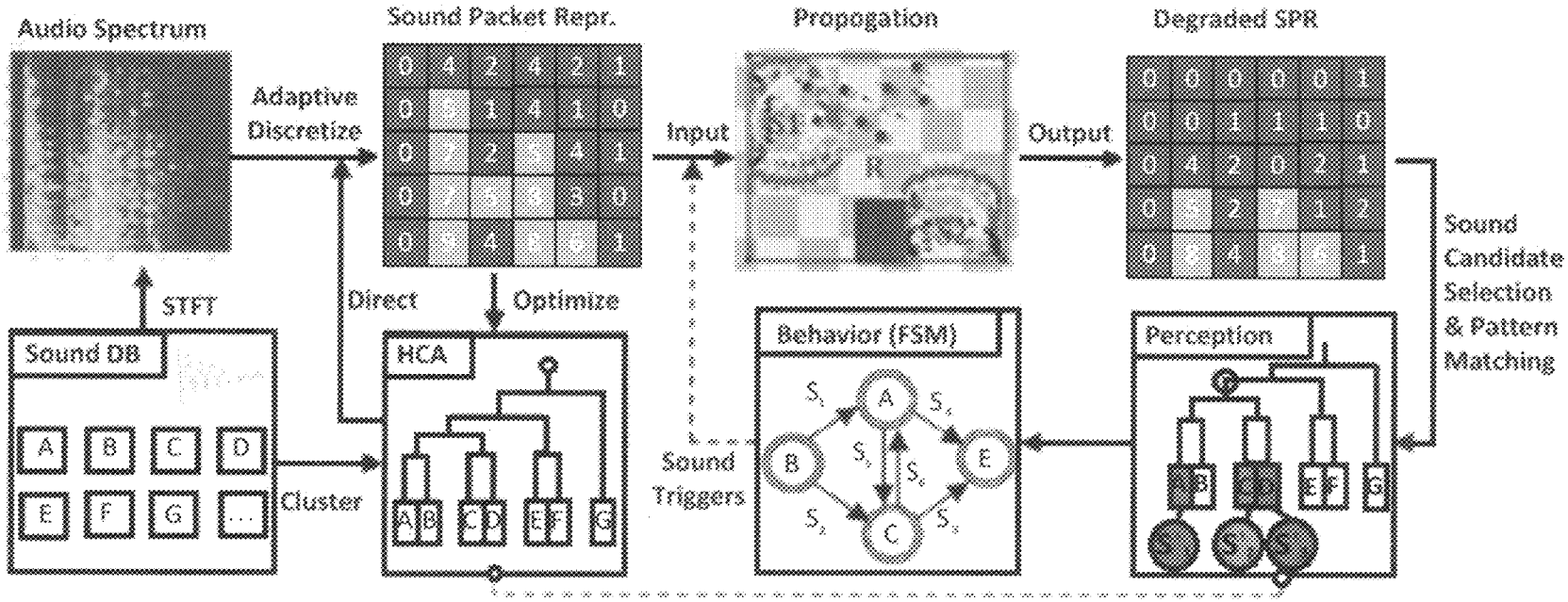
FIG. 2B illustrates an overview of a framework for sound propagation and perception for autonomous agents in dynamic environments (SPREAD) in accordance with the invention

FIG. 2A illustrates an exemplary summary of a method 200 for sound propagation and perception for autonomous agents in dynamic environments, as discussed in more detail herein. FIG. 2B illustrates a graphical representation for sound propagation and perception for autonomous agents in dynamic environments. In accordance with the method of the invention, as shown in FIG. 2A and FIG. 2B, as step 201 a set of acoustic features is determined which may be placed in database. A minimal yet sufficient set of acoustic features may be described to characterize the human-salient components of a sound signal. These features include amplitude, frequency, and duration, which are correlated to sound classification. In addition, a real-time sound packet propagation and distortion model may be developed using adaptive 2D quad-tree meshes with pre-computed propagation values suitable for dynamic virtual environments.

With further reference to FIG. 2A, at step 203, a sound packet representation is determined, which may be based on the output of step 201. The Short Time Fourier Transform (STFT) of sounds in the database of step 201 is adaptively discretized in the frequency and time domain to compute the Sound Packet Representation (SPR), which may be optimized to match the hierarchical clustering analysis (HCA) from human perception studies. At step 205, the SPR packets are propagated. During simulation, SPR packets are propagated in the environment using the Transmission Line Matrix Method (TLM), which accounts for sound packet degradation based on distance traveled, absorption, reflection, and by obstacles and moving agents in the environment. To reduce computational costs, a quad-tree-based precomputation may be added to accelerate the propagation model. The original algorithm may be ported to the GPU for further acceleration. At step 207 one or more virtual agents receive the SPR packets, which may have some degree of degradation. Once the SPR packets are received Dynamic Time Warping (DTW) may be used to compute a similarity score with sounds in the database. At step 209, approximate perception is determined. If multiple sounds from the HCA are above a similarity threshold, their Lowest Common Ancestor (i.e., the more general sound category) is perceived to facilitate approximate perception. At step 211, the one or more virtual agents may have behaviors triggered based on the perceived perception. Sound perception results are used as control signals to trigger agent behavior. Using this framework, virtual agents possess individual hearing.

During an offline process, a sound database is built using a discrete sound packet representation, and similar sounds are grouped using Hierarchical Clustering Analysis (HCA) for agent sound perception. During simulation, sound packets are propagated through the scene based on the Transmission Line Matrix (TLM) method, which accounts for sound packet degradation based on distance traveled, and on absorption and reflection, by obstacles and moving agents in the environment. To reduce computational costs, a quad-tree-based precomputation is added to accelerate the propagation model. The original algorithm has been ported to the GPU for further acceleration. Agents receive a series of environmentally altered sound packets and use Dynamic Time Warping algorithms to identify similar sounds from the HCA. If multiple sounds from the HCA are above a similarity threshold, their Lowest Common Ancestor (i.e., the more general sound category) is perceived. Using this framework, virtual agents possess individual hearing.

As will be apparent from the following, contributions of the invention to the art may include: 1) an adaptive discretization of continuous sound signals to obtain a minimal, yet sufficient sound packet representation (SPR) necessary for human-like perception, and a hierarchical clustering scheme to facilitate approximate perception; 2) efficient planar sound propagation of discretized sound signals which exhibits acoustic properties such as attenuation, reflection, refraction, and diffraction, as well as multiple convoluted sound signals; and 3) agent-based sound perceptions using hierarchical clustering analysis that accommodates natural sound degradation due to audio distortion and facilitates approximate human-like perception.

Experimental results show that the disclosed propagation framework works efficiently for multiple and different sound signals in dynamic virtual environments. A sound signal is identified if the agent is close to the source or a sound is less attenuated, absorbed, or reflected in the scene; conversely a sound is difficult to identify as sound packets suffer from spectrum interval degradation and overlapping effects. The sound propagation methodology is not just based on distance, but takes into account the static environment, dynamic (e.g., agent movements) features, and packet content degradation. Sound propagation and perception for autonomous agents in dynamic environments (hereinafter SPREAD) is integrated into agent attention and behavior models and demonstrates several novel game-like simulations that greatly enhance both play and user experiences. The method may serve as a companion to auralization (i.e., the production of human perceivable audio signals)—enabling virtual agents to hear and classify sounds much like their real human counterparts. Auralization is not a prerequisite for this capability.

Prior virtual human research aimed to simulate interacting autonomous agents. Commercial tools such as Unity3D 2012 provide intuitive user interfaces to modify different sound features for sound synthesis; however, no tools exist to recreate more human-like sound perception.

Since the seminal work of Takala and Hahn 1992, sound synthesis models have been proposed for complex physical phenomena such as rigid body fracture and object contacts. Works since then have detailed audio feature computations: e.g., root mean square, frequency, centroid, and duration. In that work, amplitude, frequency range, and duration are used as a simplified but perceptually adequate basis for an environmental sound packet representation.

In other prior work, sound is propagated in virtual environments using beam tracing or frustum tracing. These methods treat the sound signal as rays and are unable to model acoustic properties such as diffraction. Another work uses the Finite-Difference Time-Domain method, coupled with an adaptive resolution representation of the environment for efficient sound propagation. The Transmission Line Matrix (TLM) method uses cellular automata to model sound propagation in a uniformly discretized environment and can demonstrate effects such as diffraction, absorption and reflection. In other models, both numerical and geometric methods are used to construct a virtual acoustics environment with auralization and signals degradation. The empirical sound absorption rate for many materials is documented. Sound intensity attenuation is often approximated as a quadratic function of distance.

When an output sound is captured by an input device, its overall power is attenuated; moreover, as the high frequency loses power, the low frequency bands gain from this loss. Such a frequency power shift will affect sound perception at least as significantly as direct power attenuation with distance.

Human factors experiments have been conducted to understand the relevance of sound properties for sound similarity. The experiments conclude that amplitude, duration, and pitch correlate with the principal components of sound classification. Based on these human judgments a hierarchical organization of 100 environmental sound signals is generated which clusters sounds that were perceived to be similar. Other work consider human voice signals and propose a sound propagation model to simulate how agents communicate via speech signals which experience only amplitude reduction and signal-noise-ratio effects. Sound perception in virtual agents may be modeled by considering sound localization, the sound pressure level of the human voice, and the clarity of the perceived signal. However, in prior work the effects of environmental propagation are not modeled and the understanding of speech signals is based on fixed thresholds. Herein we consider the Gygi et al. C. 2007 (*Similarity and categorization of environmental sounds. Attention, Perception*, & *Psychophysics*) environmental sound set as its perceptual classification is available; this removes consideration of language, speech qualities, content (semantics), and comprehension.

For simulation, perceptions map to behaviors. A perceptual model may include various sensing modalities. In some hearing models, distance determines sound spread amplitude, and then amplitude and agent attributes co-determine their information gains. Different properties may be modeled on a limited number of representative frequency bands which is an approach similar to the sound representation adopted here. Active and predictive perception and attention to objects may play a role in agent behaviors.

Sounds are continuous signals that are typically represented as 1-dimensional (1D) wave forms. A discretized sound representation should sufficiently capture the distinguishing properties of different signals and facilitate efficient sound propagation in complex environments while exhibiting appropriate sound degradation. This sound data representation is received by agents who apply human-like sound perception models that determine whether any identifiable sound or sounds have been heard and, if so, what sound type or category they appear to represent. In signal processing, a large number of features are used to represent sound for signal analysis. Human perception, however, is usually correlated to a small subset of features for environmental sounds, such as frequency, amplitude, and duration.

Sounds attenuate and degrade due to the environmental influences of reverberation, reflection, and diffraction. These effects cause sound signals to degrade in a nonlinear fashion, resulting in complete attenuation, lack of perceptual specificity, or even incorrect classification of sound signals. For example, a ship noise may be perceived as a generic mechanical noise, possibly misidentified as a construction noise which is perceptually similar, but should not be misinterpreted as a harmonic sound such as a siren.

Figure 3:
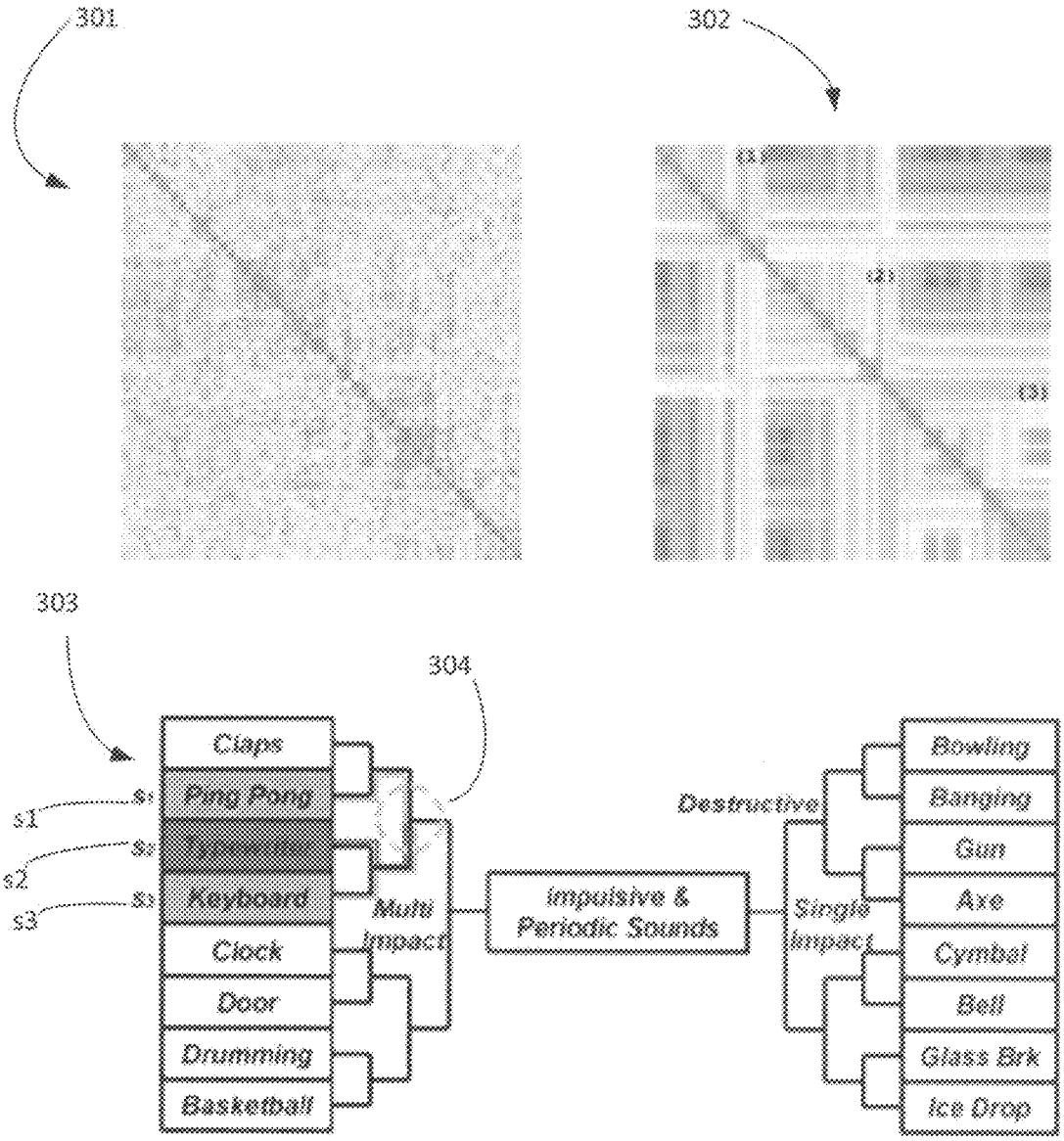
FIG. 3 illustrates a sound perception similarity matrix.

FIG. 3 illustrates the hierarchical clustering analysis of sounds in the database to enable approximate sound perception. Block 301 is the similarity matrix of the sound signals computed from human perception studies, and Block 302 is calculated from the discretized Sound Packet Representation, optimized to match 301. Darker sections indicate higher similarity between sounds. Tree 303 illustrates a partial hierarchical clustering analysis tree (HCA) computed by transformation of 302 via Multidimensional Scaling. Note that if multiple sounds are identified as similar to a given signal, it is set forth herein that people will perceive that signal as a coarser category which is the least common ancestor (the circle 304) of the sounds (s1, s2, and s3). This idea will be described in detail in the perception section discussed below.

Human categorization of 100 sounds has been investigated in prior work with an average of 1 second duration, providing a representative sound database of common environmental sounds. The subjects were required to rate the similarity between any two of these sounds, 10000 pairs in total. Note that there are three clusters with close intra-cluster similarity, and they are later tagged as harmonic sounds, impulsive and impact sounds, and continuous sounds. Based on the similarity matrix, the HCA technique is applied and used to construct a hierarchical clustering of these sounds, as shown in FIG. 3 at 302.

A subset of the full HCA tree is depicted in FIG. 3 at 303. Perceptually similar sounds are closer in the tree, e.g., typewriter and keyboard sounds are under the same node and their HCA distance (tree-edge) is two units (one unit from typewriter to its parent node plus another one from the parent node to keyboard). The distance metric applies to any two sounds in the tree. The branch nodes are named to describe the meanings of a cluster of sounds that are under that particular branch; e.g., gun and axe sounds are clustered as destructive sounds. All right-side sounds are single impact sounds, and the overall tag is impulsive for the sounds in FIG. 3.

These 100 sounds provide a representative set of common environmental sounds, and these existing perception studies are leveraged to ground the herein disclosed approach in human factors research. The sound duration is limited to about 1 second which is long enough for a distinct sound event, while sounds with longer durations may be segmented and processed in sequence. The disclosed framework may be extended to new sounds by importing raw sound data and extending the HCA tree. The clustering information may be acquired from existing studies, running new human subject experiments, or manual labeling.

A sound signal is traditionally represented by a wave-time or spectrum-time graph which models these three fundamental features. SPREAD (sound propagation and perception for autonomous agents in dynamic environments) employs a packet based discretization of sound—the sound packet representation (SPR) based on the short-time Fourier transform (STFT) analysis technique—which can be propagated using computational methods.

Figure 4:
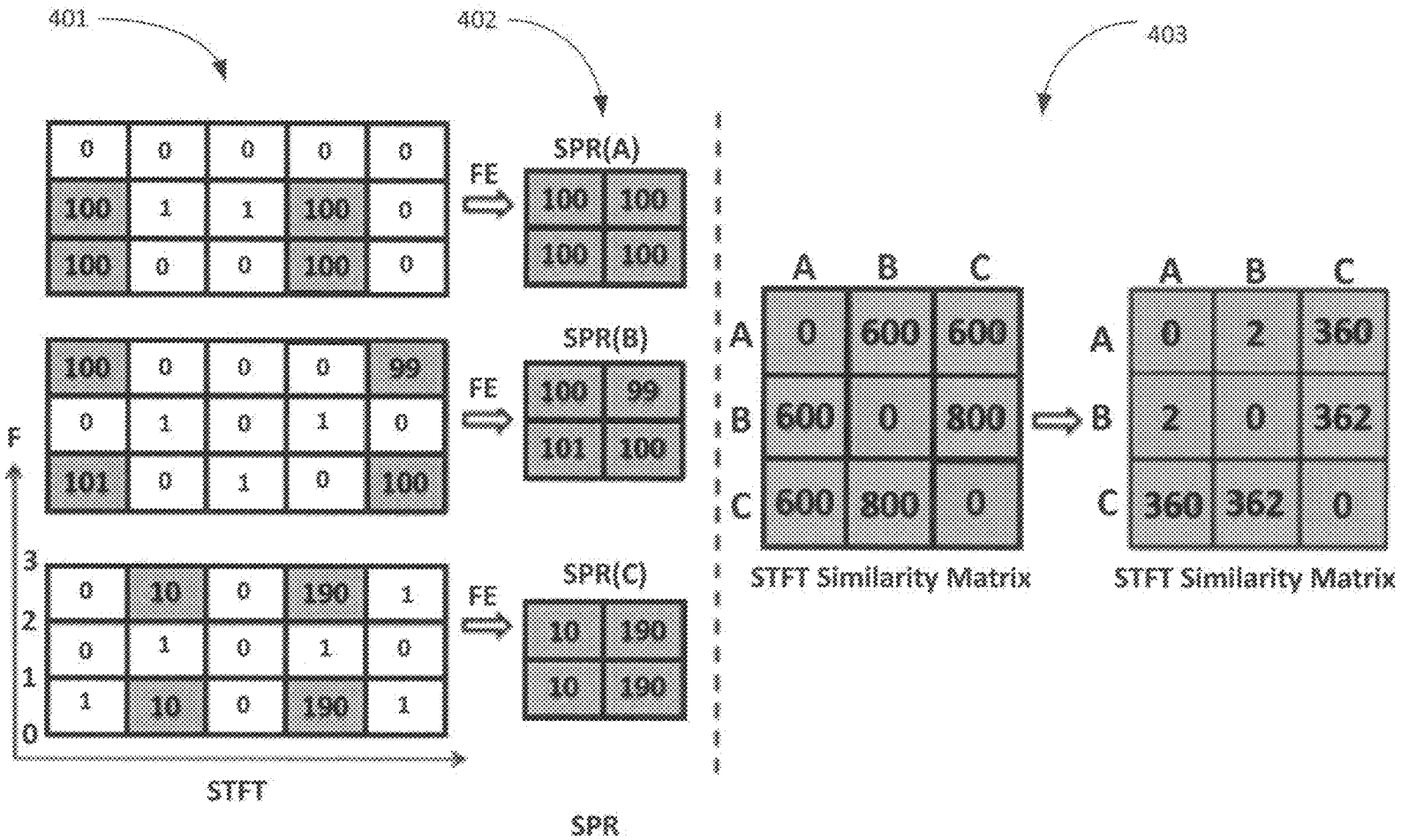
FIG. 4 illustrates sound packet representation (SPR)

FIG. 4 illustrates a method for sound packet representation (SPR). The left diagrams 401 illustrate the STFT conversion of the sound signal by uniformly segmenting the time (T) and frequency (F) domains, where the numerical values are the amplitudes within each discretized block. The middle SPR column 402 shows the feature extraction (FE) process which determines the most distinct features among all blocks that are packed into the SPR. The right diagrams 403 show the construction of different representations in order to find an optimized similarity matrix that best matches the known HCA clusters.

FIG. 4 also shows the reduction of the number of packets by using fewer frequency bands and only storing packets for sound segments with a significant amplitude. Along the horizontal axis, a signal is represented as a time-varying packet sequence. Either one packet with one amplitude value in a frequency range is generated at a time step or multiple packets for various frequencies are generated at each time step.

In SPREAD, a packet p(i, j) is denoted as $<a, r=r_L, r_H), s>$, where i is the time axis index, j is the band index along the frequency axis, a is the amplitude, $r_L$ is the lower bound of the perceptive frequency band, $r_H$ is the upper bound, and s the spread factor which defines the degradation extent of the packet. Thus, a sound signal is represented as a collection of packets $\{p(i, j) | t_0 \le i \le t_n, b_0 \le j \le b_m\}$. The time duration of the sound signal is the total length of the packet series $t_n - t_0$ along the time axis.

Described below is an algorithm to extract the minimal yet sufficient set of packets in M frequency bands and N time slots from the original STFT data to represent a sound and the correct clustering of sound categories. Overall SPREAD efficiency is improved if unnecessary packets (relative to the selected sound database) are eliminated.

SPR is for a single sound whereas HCA is for multiple sounds. To establish a meaningful relation between these two a comparison measure is defined within the simulation. What is desired is that sounds under the same or close clusters may be measured and evaluated as perceptually similar, while those which are more distant are judged as different. The chosen comparison measure operates on subsets of the sound packet data.

Dynamic time warping (DTW) is a technique to compare two time sequences, and SPREAD uses it to determine the similarity between two sounds in wave and/or STFT spectrum forms. Note that packet sequences will have ||N|| frames and within each frame there will be M packets in different frequency bands. The difference between any two frames are defined as the sum of all the corresponding packet pairs (i.e. $d(f_j, f_k)=\Sigma(q_{mi}-r_{mi})$). The distance DTW $(s_a, s_b)$ between two sound signals $s_a$, $s_b$ is computed by applying the Dynamic Time Warping algorithm to the packet sequences in $s_a$ and $s_b$, as in Eq. 1:

$$\mathrm{DTW}(s_a,s_b)=\min\{C_p(s_a,s_b), p\in P_{len(sa)\times len(sb)}\} \quad (1)$$

where $len(s_a)$, $len(s_b)$ are the total number of time frames of $s_a$, $s_b$ respectively, $P_{len(sa)\times len(sb)}$ is the set of all possible warping paths in the cost matrix d(i, j), and $C_p(s_a, s_b)$ is the cost of two sequences along the path p which is the min-cost frame-to-frame mappings between them from the beginning to end along the time indices. The amplitude a, frequency band range r, and spread factor s are used to compute the metric difference between any two packets (i and j) in the sequences: $d(i, j)=\mu(a_i-a_j)+\nu(1-ri\cap rj/r_i\cup r_j)+\xi(\|(si-sj)/(si-sj)\|))$. In the problem setting, there is $\mu=100$, $\nu=1$, and $\xi=1$.

The requirements for SPR are that it: 1) be minimal yet sufficient (the goal is to be the minimum representation that can sufficiently distinguish between all leaf nodes in the HCA tree); 2) should not be so fine that it incorrectly discriminates similar sounds in the same category; 3) should be computationally efficient (as a smaller subset of data may be used). Thus, optimal representational subsets of the data may be found using Algorithm 1, Eq. 1 and Eq. 2. In Eq. 2, t denotes a tree node, $R_t$ is the regularization value on t, R is the total, (a, b) denotes all subleaf node pairs under the tree node t, and D is the DTW function as defined herein.

$$R=\Sigma tRt$$

$$R_t=0, \text{ if } t \text{ is a leaf node}$$

$$\Sigma_{(a,b)}D(ta,tb)/\#\text{ of }(a,b)\text{pairs if } t \text{ is not a leaf node} \quad (2)$$

Algorithm 1 below is sound packet representation optimized to match with the HCA Tree. H is the HCA node-to-node tree distance matrix. R is a tree regularization term, which is defined in Eq. 2:

```
Input: Sounds S = {s} in STFT form, HCA Similarity Matrix H
Output: Sound Packet Representation M, N
Given M = {M_s} (||M_s|| ≤ 10), N = {N_s} (||N_s|| ≤ 200);
1) Generate randomized sampling sets on frequency/time slots:
foreach Sound s in S
do
        M_s = (i_0 ≤ i_1, ..., i_m)_s & (N_s = j_0 ≤ j_1 ..., j_n)_s;
end
2) Construct SPR(s, M_s, N_s) for each sound in S;
3) Compute the DTW similarity matrix D on SPRs:
4)      foreach Sound signal pair (SI, SJ) ∈ S × S do
        D(I, J) = DT W (SPR(SI), SPR(SJ));
end
5) Normalize D and calculate V = ||H − D||_2:
Iterate 1) - 4) to find the best M, N = argmin_(M,N)(V + R);
```

The SPR framework selects representative frequency and amplitude features from audio clips, but the sparse sampling may fail to capture salient differences that a person would normally perceive, while dense sampling may introduce noise and error and also fail to show distinct differences. To minimize this ambiguity an algorithmic feature selection process is used based on human sound perception. Feature selection is optimized to match the target sound perception space stored in an HCA tree structure, so that the difference between any two signals has a distance similar in scale to the corresponding two nodes of the HCA tree.

Sound Perception Similarity Matrix, in which sound-to-sound similarity is calculated by DTW on the following different datasets (M is number of frequency bands and N is number of time samples): At block 501 of FIG. 5, the original STFT data consists of, on average, 500 time slots and 512 frequency bins. At block 502 of FIG. 5, SPR data constructed from HCA using M=1 and N=3 making the sounds hardly distinguishable. At block 503 of FIG. 5 using M=3 and N=100. At block 504 of FIG. 5, using M=6 and N=150. At block 505 of FIG. 5 using M=10 and N=200. In (f) of FIG. 5, the curved surface image shows that if M and N are set to their maximums (10 and 200, respectively) then the similarity error V is minimized. Lower M and/or N increase error. A suitable error tolerance may be set at the application's, e.g., to meet timing constraints in a real-time game setting.

Figure 5:
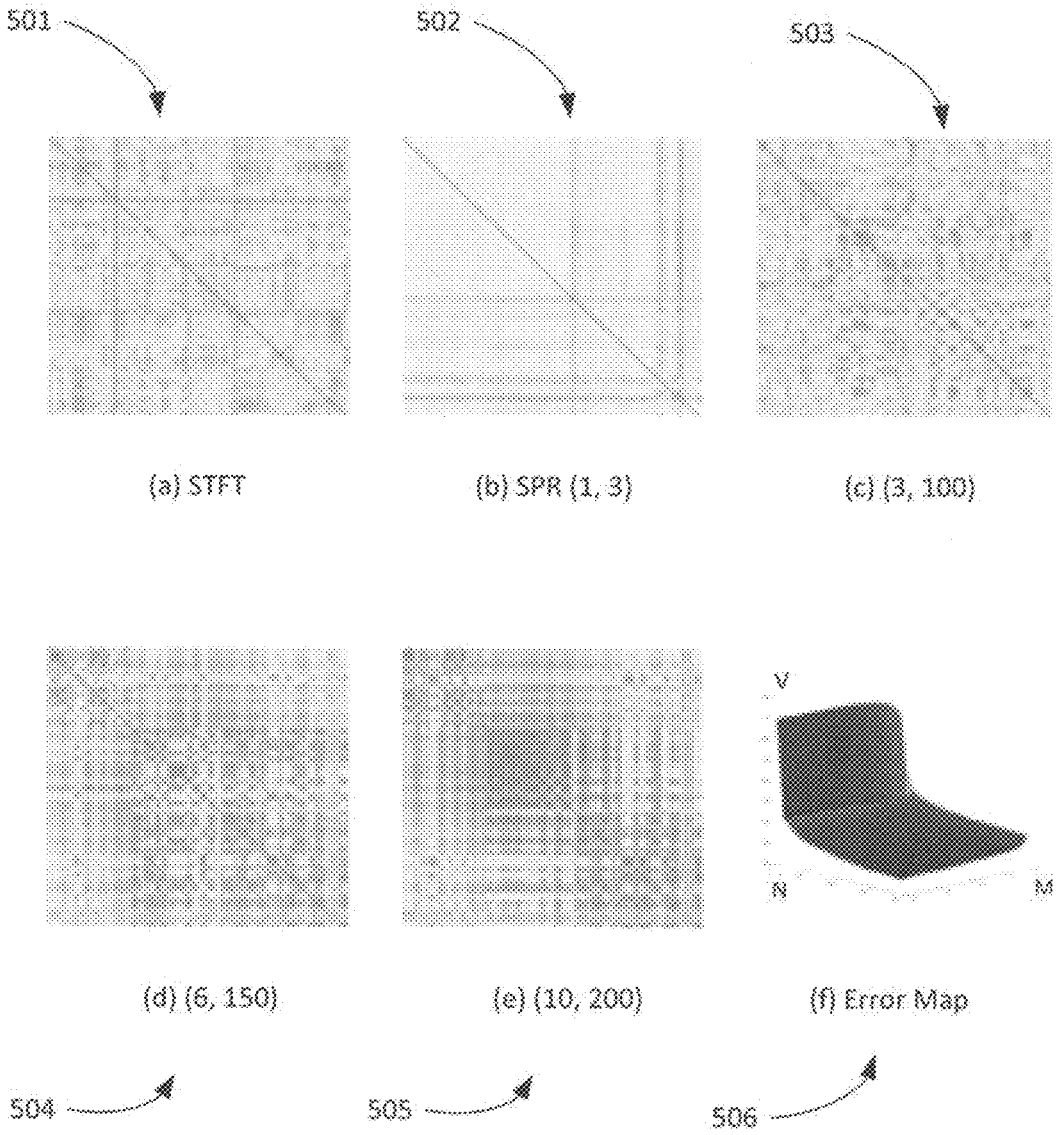
FIG. 5 illustrates a series of sound perception similarity matrix results based on different configurations, and their error map.

FIG. 5, at block 501, shows that the ordering of sound signals based on HCA tree distance may differ from the ordering based on the distance computed using DTW, resulting in incorrect perception clusters of sound signals. To offset this issue, features of the sound signal are selected by sampling at specific time slots such that the computed distance aligns with the perceived difference. Algorithm 1 describes the feature selection process by choosing a set of sampling slots N, M along the time and frequency axes such that the DTW distance between all sound signals is aligned to their HCA distance. If we compute the similarities among the complete dataset shown in block 501, the result differs too much from human perception and will give unsatisfactory or implausible matches. After the optimization and construction algorithm, the similarity is shown in block 502, which matches well the human subjective results. The factor analysis is shown in block 503.

Many sound propagation methods exist, such as FDTD and FEM in the numerical acoustics (NA) field, and ray-tracing and beam-tracing in the geometry acoustics (GA) domain. Herein, a rectilinear cellular space that approximates the physical environment of static and dynamic objects (such as other agents) is used, and propagates sound by the TLM Cellautomata acoustics (CA) model. CA's computational cost is independent of the number of agents; GA increases per agent. Also, GA physically approximates sound waves as lights, and the GA diffusion model is expensive, whereas CA inherently models all sound/environment interaction effects.

Figure 6:
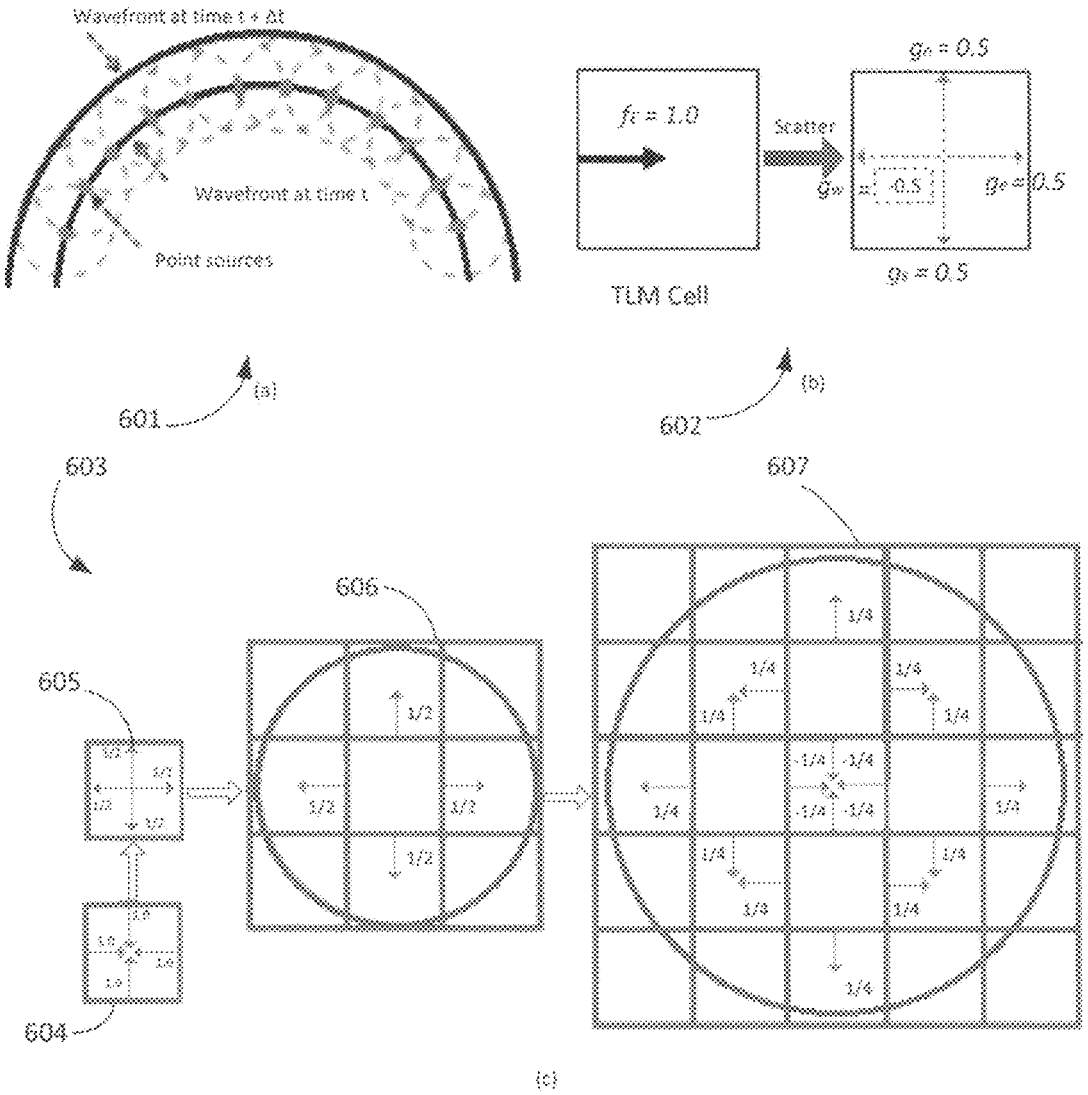
FIG. 6 illustrates the Huygens principle starting from a spherical point source.

The sound signals received by agents depend on the cell they occupy, but their other actions (such as navigation) are not restricted to this grid. Changes in a packet's feature value are governed by formulas for sound propagation effects. The TLM method belongs to the cell-automata acoustics (CA) category along with other methods such as Lattice-Gas and Lattice-Boltzmann models, and it is based on Huygen's principle, as shown in FIG. 6 at 601 (also denoted as (a)) and at 602 (also denoted as (b)) FIG. 6, that each point in the wavefront is a new source of waves. Given a grid-based discretization of the scene, the sound distribution may be calculated by: 1) updating the current energy values for each grid cell and 2) for each neighbor of each grid cell calculating the energy that will be transferred from the center grid to the neighbor grid.

FIG. 6, at 601, is an illustration of Huygens principle whereby starting from a spherical point source, the wave front in the next time step is formed by propagation at the border of the current one. FIG. 6, at 602, illustrates grid-based sound packet propagation: A original incoming packet (the energy with an arrow pointing to the center of the TLM cell) will scatter into four subpackets ($f_E \rightarrow \{g_N, g_E, g_S, g_W\}$) which are the out-going packets to be transmitted to its neighboring four-connected cells (N,E,S,W), where they become new incoming packets in the next time step. FIG. 6, at 603, is a step-by-step illustration of TLM sound amplitude propagation. The block 604 shows the original unidirectional energy at one grid (with 4 identical incoming packets). The block 605 shows the result after one scattering step when these 4 incoming packets become 4 outgoing ones. The block 606 shows the next propagation step and the block 607 shows the result after two iterations of scattering and propagation, resulting in a nearly circular wavefront moving outward.

Within a cell of one TLM layer, there will be 4 slots for incoming packets from its connected neighbors, and 4 outgoing packet slots toward them too. In a scattering phase, incoming packets that are originated from SPR sources or collected from neighbors will scatter and transmit to the outgoing packet slots, and then in the collection phase outgoing packets will be collected by the neighbor cells in corresponding directions and put into their incoming slots.

Iterating these two phases transmits packets throughout the grid. If an incoming packet originates at an SPR source its add-in time is set by the time frame index in SPR (e.g., $p_i$ will be generated at time i $\Delta t$), and its wave-form impulse amplitude value is also set from the SPR's variable. Note that two impulse sounds must be separated by an equal length series of zero-amplitude packets to avoid interference.

FIG. 6, at 601 and at 602, illustrates TLM propagation. The scattering rule is given in Equation 1, where f is the current grid cell, $a(g_i)$ is the outgoing value to its neighbor grid g in the i direction, op(i) is the opposite direction of i, and $a(f_i)$ is the incoming value in the i direction at f $\alpha(g_i)$ is the absorption or attenuation rate at grid $g_i$. The packet collecting rule from a cell to its neighbor cell is defined in Equation 3.

One can model reflection and absorption effects in TLM by using different energy filters in the cells. To model reflection, those vector values which reach a wall will reverse direction as shown in Equation 4. Furthermore, TLM can demonstrate sound diffraction. Since it models how a vector value scatters into a number of sub-vectors with new values and these new ones will collect and scatter again in each iteration, any vector values that pass through a narrow bottleneck into an open area will disperse and be regenerated again. The process is also described in Algorithm 2.

$$a(g_i)=\alpha(g_i)(-a^*(f_{op(i)})/2+\Sigma_{j1=op(i)}a(fj)/2) \quad (3)$$

$$a(\text{Neighbor}(g_i))=a(g_i) \quad (4)$$

$$a(f_{i'})=\text{Collect}(i;\{a(g_0);a(g_1);\ldots;a(g_k);\ldots\})=\Sigma_p a(g_p) \quad (5)$$

$$a(g_i)=\alpha(g_i)^*a(f_i) \quad (6)$$

Algorithm 2: The TLM Algorithm for a Uniform Grid:

```
Input: Pre-propagation grids that contain sound packets
Output: Post-propagation grids that contain sound packets
foreach Grid f do
    foreach outgoing direction D_i ∈ { N; S; E; W } do
        Let g_i be the outgoing packet toward the neighbor grid cell
        along i;
        Let F = { f_N ; f_S; f_E; f_w } be the incoming packets from
        neighbors off;
        if f is a wall cell then
            Update g_i <= Reflect(i; f_i) (Eq. 6);
        end else
            Update g_i <= Scatter(i; F ) (Eq. 3);
        end
    end
end
foreach Grid f do
    Collect packets from the scattering phase: g_i' = Σ_p g_i (Eq. 5);
end
```

TLM may simulate multiple simultaneous sound sources anywhere in the grid. Packets at the same locations and the same bands will be merged and their amplitudes added. The TLM grid can also represent 'constant' ambient sounds (e.g., general levels of traffic noise) that sum with other transient packets. Such levels can be ascertained empirically or from other simulations and create appropriate perceptual confusions. Moreover, the agents themselves can generate local sounds (footsteps, handclaps, or non-linguistic utterances) in the grid. They increase the grid absorption but do not otherwise impact the propagation algorithm.

$$s(f_i')=\text{Collect}_s(i,\{s(g_0),s(g_1),\ldots s(g_k),\ldots\}) \quad (8)$$

0.01, if $g_i$ is an agent grid $$\delta_s(g_i)=0.10, \text{ if } g_i \text{ is a wall grid} \quad (7)$$

if $g_i$ is an ordinary 0.98,grid $$s(f_i')=\text{Collect}_s(i,\{s(g_0),s(g_1), \ldots s(g_k), \ldots\}) \quad (8)$$

The scatter rule is extended in Equation 7 to work for the sound packets' spread factor. Here, $s(g_i)$ is the spread factor which indicates how clear or fresh the packet is at grid g and direction i, and $\delta(s)$ is the decrement multiplier for the factor. The collection rules in Equation 8 merges the incoming packets together with their spread factors merged (summed). These changes do not affect TLM. The focus is on propagating key packets, modeling their interactions, and tracking their degradation with the spread factor.

Note that the framework did not fundamentally change TLM, but only key segments of (wave) packets were propagated, their interactions and impacts modeled, and their spreads tracked during propagation. The spread is regarded as a factor of how much a packet has endured or degraded and how many HCA candidates are qualified.

Algorithm 3 includes pre-computation of propagation values in quad tree. Note that His a cached set of packets for a square region of size z (which can only be 1, 2, 4, . . . due to quad-tree settings), and for the case that a trigger packet is incoming at border grid b in the I direction. It stores the propagation patterns at the border grids from time $t_1$ to $t_{max}$ i.e. L. The last sorting step is to reduce unnecessary checking in latter frames of the set. For example, in time t a cached value $h_t$ is already smaller than a threshold z, so checking t+1, t+2, . . . is no longer necessary. Algorithm 3 shown below:

```
Input: Quad tree Q
Output: Precomputed propagation values H
foreach Possible Size z of the Grids in Q do
    Let B be a uniform grid of size z × z;
    foreach Border grid b ∈ B do
        foreach Incoming i ∈ {N, S, E, W } do
            Incoming unit energy in B at b from i;
            for t = 1; t < L = t_max; t + + do
                B_t = TLM(B_{t-1}, b, i);
                H(z, b, i) = H(z, b, i) ∪ B_t;
            end
        end
    end
end
```

Sort all H values in ascending t & descending amplitude;

As shown in prior works, the speed of sound C in TLM is determined by $C=\Delta x/(\text{sqrt}(2)*\Delta t)$, where $\Delta x$ is the space resolution (grid granularity) and $\Delta t$ the time resolution. By tuning these parameters here, the desired physical speed of sound can be produced.

Error might be introduced due to two issues in TLM. The first is the directional problem, because the packets propagate along the axes, where they move faster than along the diagonals. This problem is frequency-dependent and is negligible when the wavelengths are much larger than the cell lengths.

The second issue relates to the spatial resolution of the grid. Currently the basic spatial reference resolution is 32 units (in Unity3D). Using the normal update rate of 0.01 s, the sound speed is about 2000 units/s. If the wavelength is about 10 times as large as the grid cell size, the TLM error will be negligible. By subdividing the basic reference grid into its finest resolution (from 32 units to 1 unit) and match its time update rate accordingly, SPREAD can simulate frequency bands from 20 Hz to about 1 KHz. This decently covers environmental sounds for human perception but may be less adequate for human speech and sounds with high harmonics, e.g. higher frequency simulations may demand more computational power and finer grids. TLM was implemented on a GPU to exploit that additional power.

The new process as discussed herein may propagate packets with M different frequency bands in different resolutions of grids whose unit length $\delta=C/f$, where f is the specific frequency for the targeted band. This may lead to at least a couple of results. The first mitigates the frequency-related grid resolution error. Second, since SPR data contain a limited number of frequency bands, increasing the number of bands improves the simultaneous propagation of multiple separate but interacting sounds. The trade-off for higher accuracy is that as M (number of frequency bands) increases there is a need to allocate more space and the algorithm runs slower.

Figure 7:
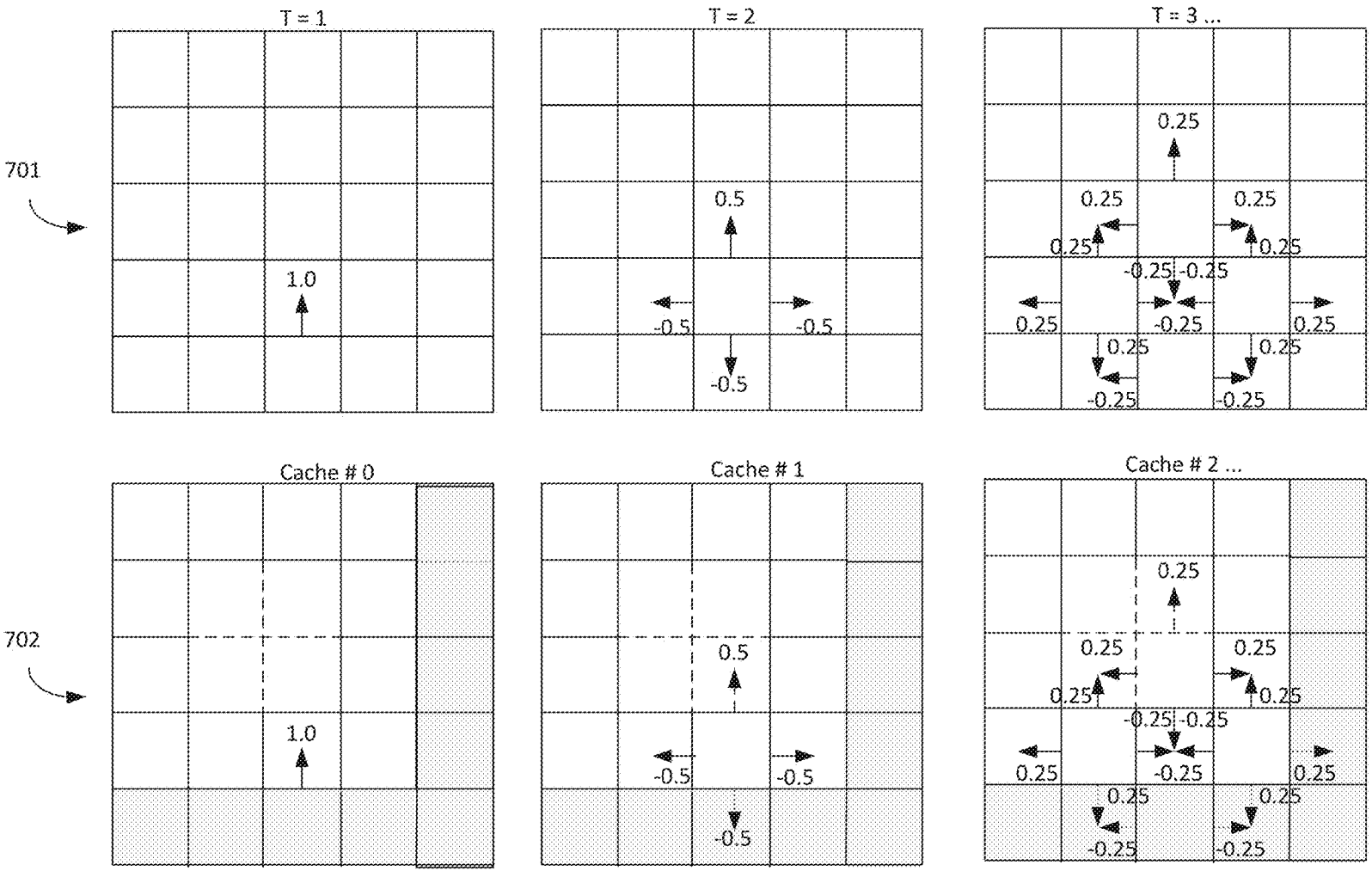
FIG. 7 illustrates using the transmission line matrix (TLM) pre-computed cache.

For a square region with the same sound attenuation property, the propagation pattern is the same and is proportional to the original source energy, which can be pre-computed and cached. FIG. 7 shows that, for a square region with a uniform sound attenuation property, the propagation pattern is the same and is proportional to the original source energy, which can be pre-computed and cached.

In FIG. 7, which uses the TLM pre-computed cache, the top row 701 shows a number of frames for propagation in the full domain. The bottom row 702 shows a highlight view of only the border grids of a quad region (here 4×4). For a unit incoming trigger packet, its consequent propagation pattern is deterministic so can be pre-computed and cached. For any incoming packet with value v, multiply v by the cached values and apply them to future frames.

Moreover, since the sound signals that are processed are fairly short with only about 150 frames of packets, a lot of different sound triggers may be used to trigger for less than 3 seconds. This particular constraint allows us to cache some of the propagation results and accelerate the overall algorithm. Algorithm 3 describes the pre-computation of energy patterns in quads of different sizes.

The entire scene may be subdivided into quads such that each quad region has uniform acoustic properties. Given an input sound, the relevant propagation pattern may be found and its result found, and then the distribution values are assigned to the incident grids, repeating this process for each timestep. Algorithm 4 describes the modification of the uniform TLM (UTLM) algorithm to work in an adaptive quad-based environment using pre-computed propagation values. The propagation results using this method are similar to using a uniform grid, as illustrated in FIG. 8, and provides a significant performance boost as illustrated in FIG. 9.

Figure 8:
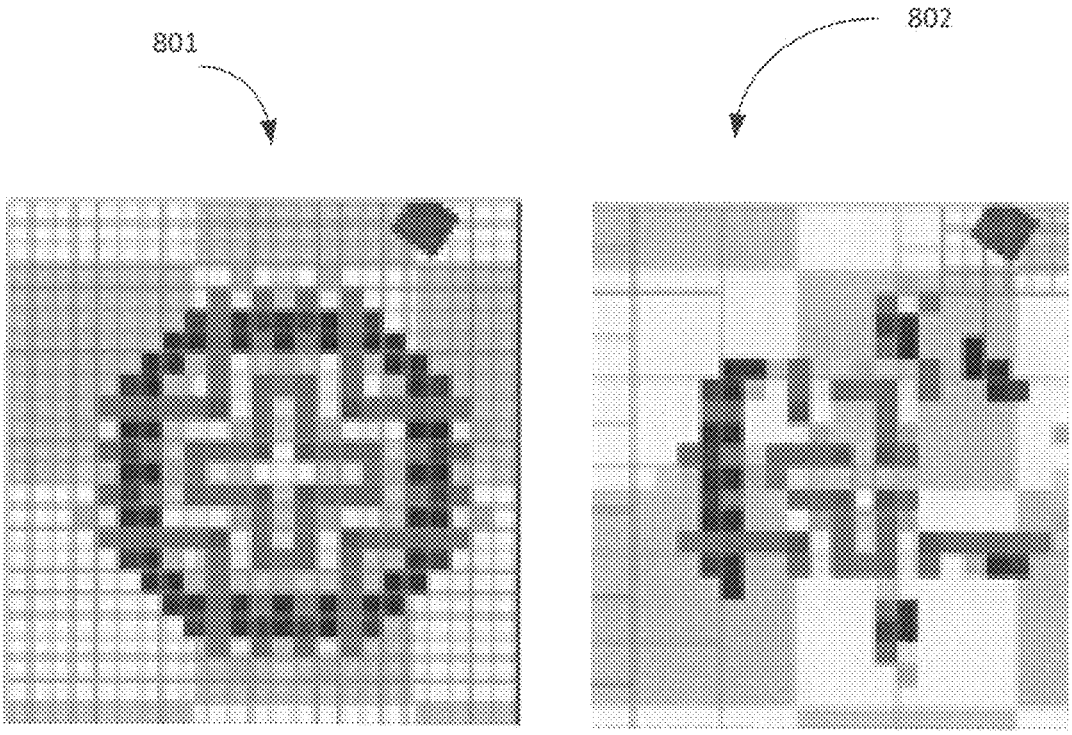
FIG. 8 illustrates TLM quad trees.

FIG. 8 involves a TLM Quad Tree. The left diagram 801 shows the TLM result on a uniform grid, where the darker shading means a high sum amplitude of all packets within the cell, and lighter shading means a low sum. The right diagram 802 shows a quad-tree grid. In the quad-tree only border grids need propagation: the 'internal' grids are unnecessary because no receivers exist within that region (if they did that region would have been previously subdivided).

Figure 9:
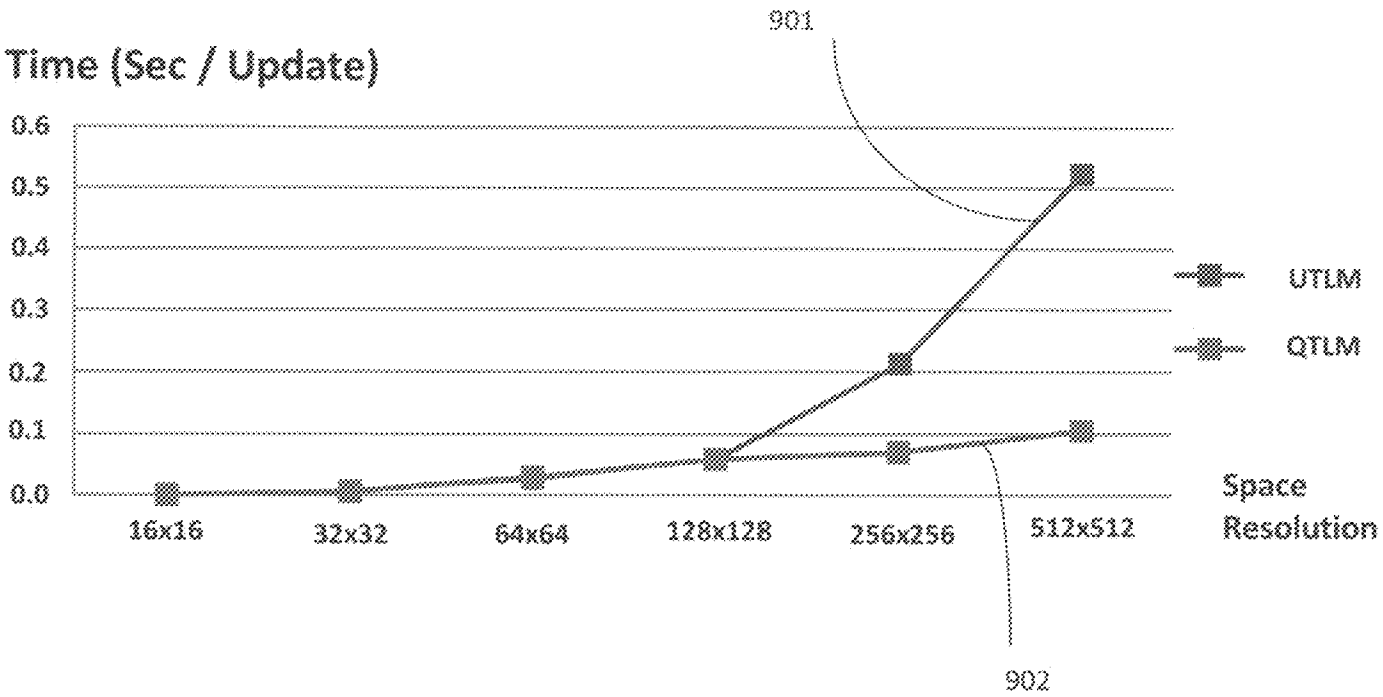
FIG. 9 illustrates a performance comparison between quad-tree TLM and uniform TLM.

FIG. 9 illustrates performance comparison between Quad-tree TLM and Uniform TLM. A shown by line 901, computational cost of UTLM increases quadratically, while QTLM (line 902) increases linearly. For a 512×512 resolution, QTLM takes about 5G memory and 15 seconds overhead pre computation on an x64 machine. But with further optimization, these constraints could be reduced further.

Algorithm 4 involves sound propagation in adaptive quad-based environment representation using pre-computed propagation values. R is the space resolution size, T is the number of border grids for the largest quad, and L is the largest index of the future frame that a cache will be saved to. The Collect step is for a set of cached packets, not a single one, and this step will introduce error if a truncation threshold is set as described in Algorithm 4. Based on experiments, with a fairly large ε=0.001, the relative error is lower than 2% within an acceptable range. Algorithm 4 is shown below:

```
Input: Pre-propagation quad tree Q
Output: Post-propagation quad tree Q'
foreach quad q ∈ Q do
    if q has existing packets then
        foreach Border Grid b ∈ q do
            if b has existing packets then
                Let q' be the neighbor quad;
                Let b' of b be the neighbor grid at q';
                Let v be the Scatter value from b to b';
                Collect v · H(||q'||, b, i) on q''s borders
                (Complexity ≤ O(T * L) << O(R * R));
            end
        end
    end
end
```

To explain why QTLM gives approximately linear runtime (with regard to the log scale of space resolution as shown in FIG. 9), UTLM on R*R grids has complexity of O(R*R) because it updates all its grids, but QTLM updates the borders of grids, which is approximately O(R) because only the border grids count. Then for each border grid's effect, it needs to update T (at most 4*R for a quad) other border grids in L consecutive frames, O(T*L) in total. Since practically a single packet won't impact most of the border grids or most of the following consecutive frames within the current one frame, T<<4·R, much less than O(R) and moreover L≤R, and in total O(T*L)<<O(R*R). In fact, the larger the value R is, the more runtime will be saved (because L<<R then) with the trade-off of greater (but one time) overhead of pre-computation time and more cache storage. Updates on quads without packets may be unnecessary.

In total, the combination gives approximately O(R*T) (O(R)) performance, also reflected in the chart. Furthermore, quad-tree pre-computation is only for each different size of obstacle-free quad (1×1, 2×2, 4×4, 8×8, . . . ), and the pre-computation does not need to consider any nested tree configurations. The limitation of this algorithm is that it is not suitable for long duration propagation because L will be very large and the computational and space cost will be very expensive. However, only high amplitude sounds will create large L. Based on existing algorithms, quad-tree updates may be achieved in O(1) complexity, as long as the dynamic changes just affect neighbor grids. This fits with the dynamic simulation framework discussed herein for autonomous agents.

Hearing helps people experience, communicate with, and react to the ambient environment and other people. Leaving aside linguistics, a sound perception model may be built for virtual agents so they can identify, as well as possible, any environmental sound packets they receive.

Agents may perceive the following types of information from any packets that arrive at their ground location: 1) the impulse responses of packets at different frequency bands and 2) the spread factor that is computed for each packet which indicates the frequency and amplitude changes due to environment interactions and attenuation. Then, to compute similarity values a DTW is used between these packets and all the sounds in the HCA database. The similarity value ranks possible leaf node matches or probable general categories related to the spread factor. The process is shown in FIG. 10.

Figure 10:
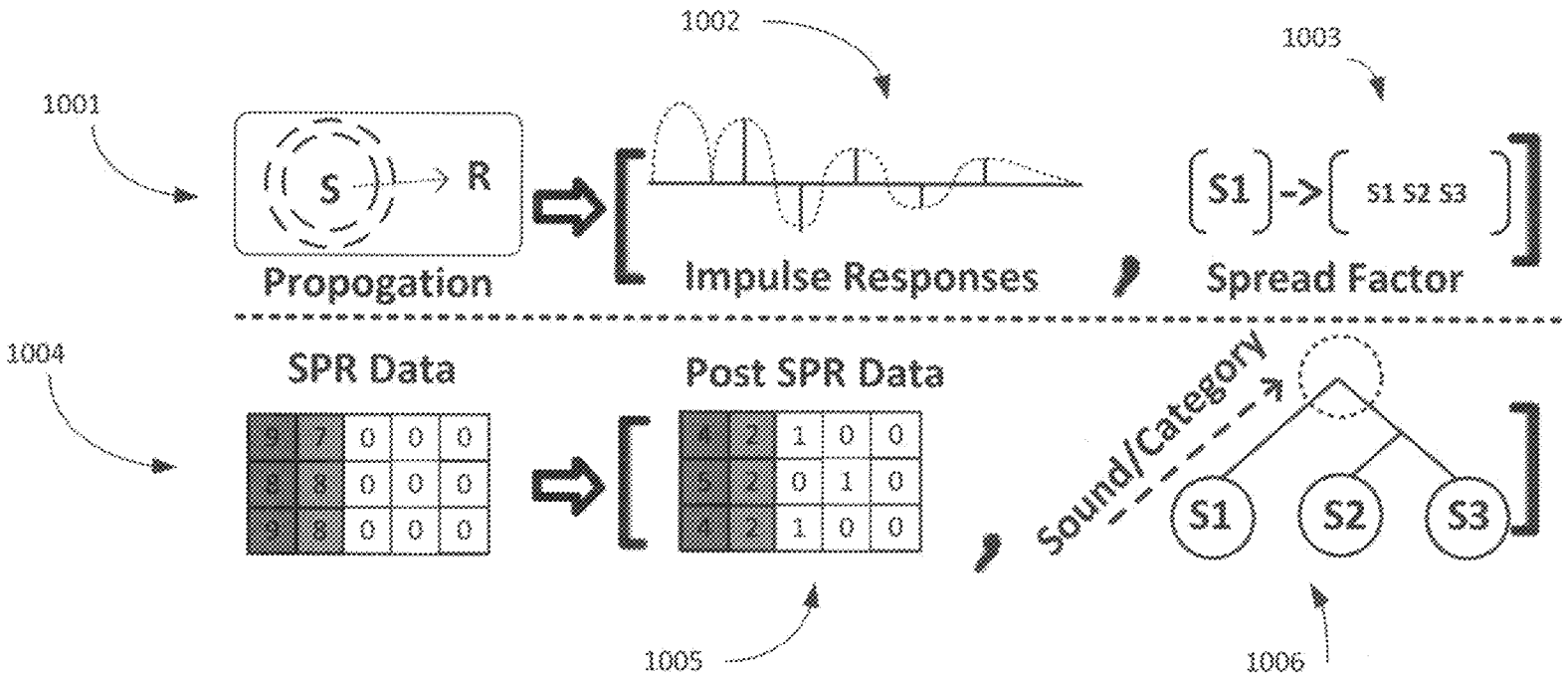
FIG. 10 illustrates post-propagation data used for sound perception model.

FIG. 10 illustrates the post-propagation data used for sound perception model. The top row 1001 shows that after propagation, the impulse responses (IR) 1002 of the original sound signal sequence (from SPR) will be received along with the spread factor 1003 indicating any frequency degradation. The bottom row 1004 shows how post SPR data 1005, which is computed based on IR, resulted from degradation and change during propagation affects the perception of sound category 1006.

Agents should be able to identify clear sounds accurately, but degradation may confound accurate identification. This is exploited to model sound perception based on the HCA tree structure. For example, ice drop and glass break are grouped as a single impact sound which is non-harmonic and impulsive. Blowing, gun, and axe sounds are grouped together into destructive in their common ancestor node, and other sounds such as clocks, drums, claps, and typewriter are grouped as multiple impact sounds. If an agent is unable to accurately perceive a sound (a leaf node) due to packet degradation, it may still find a similar sound type at a coarser level in the HCA tree. An unintelligible sound may map to the root node of the tree: the agent hears something but cannot identify what it is.

An agent may receive a temporal series of packets from more than one source. The packet series of each sound in the database are compared with the received series using DTW. Since there may be multiple sound sources, the first matched packets will be removed from the received packet set, so the extract and match processes can continue with the remaining ones. For example, in a series of received packets, suppose there are three distinct sets, and two of them are in the high bands and belong to the siren sound, then they will be used to match first. The remaining (one) low band will be used to compare with other sounds. Note that this greedy step will introduce error. Although people are good at distinguishing convolved sounds, a perfect blind source separator is difficult to model.

The spread factor value models an SPR's range dispersion. The smaller the spread factor, the more degraded and approximate will be the perception. The relation between spread factor and candidate number K is chosen to be linear, though other relations could be used instead. Assume the reference spread factor is S (i.e., 10), then if any sequence's specific spread value sum (of all the received packets) is more than 95% of S, then only the top (first) candidate will be considered and used to find the HCA node; if more than 90% then the top 2 candidates, 85% the top 3, and so on.

In terms of identifying the perceived sound information, the top K (≥1) candidates below a similarity comparison threshold (least similarity*10) are output as the set of perceived sounds. These sounds map to leaf nodes in the HCA tree structure, and we define their least common ancestor as the perceived sound category. As shown in FIG. 3, a given sound signal has similar sounds $s_1$, $s_2$, and $s_3$, and so the perceived sound category is their least common ancestor. FIG. 1 illustrates the perception results of the glass break sound at different locations: (1) open area, (2) high absorption region, (3) high reflection region, (4) blind corner, and (5) sound blocking region. The glass break sound is clearly heard in nearby or open areas, with coarseness of perception increasing in complex surroundings with obstacles and other agents. In contrast, a harmonic sound like a harp is accurately perceived in most of the areas. These examples show that the sound perception model disclosed herein accounts for sound characteristics and the dynamic configuration of the environment, and is not a simple distance based perfect reception function. The process is described in Algorithm 5.

Algorithm 5, Sound Perception Algorithm:

Input: Post-Propagation SPR Data P, SPR Database B

Output: Perceived Sound Category C, Sorted Match List M, Spread Factor S

Figure 11:
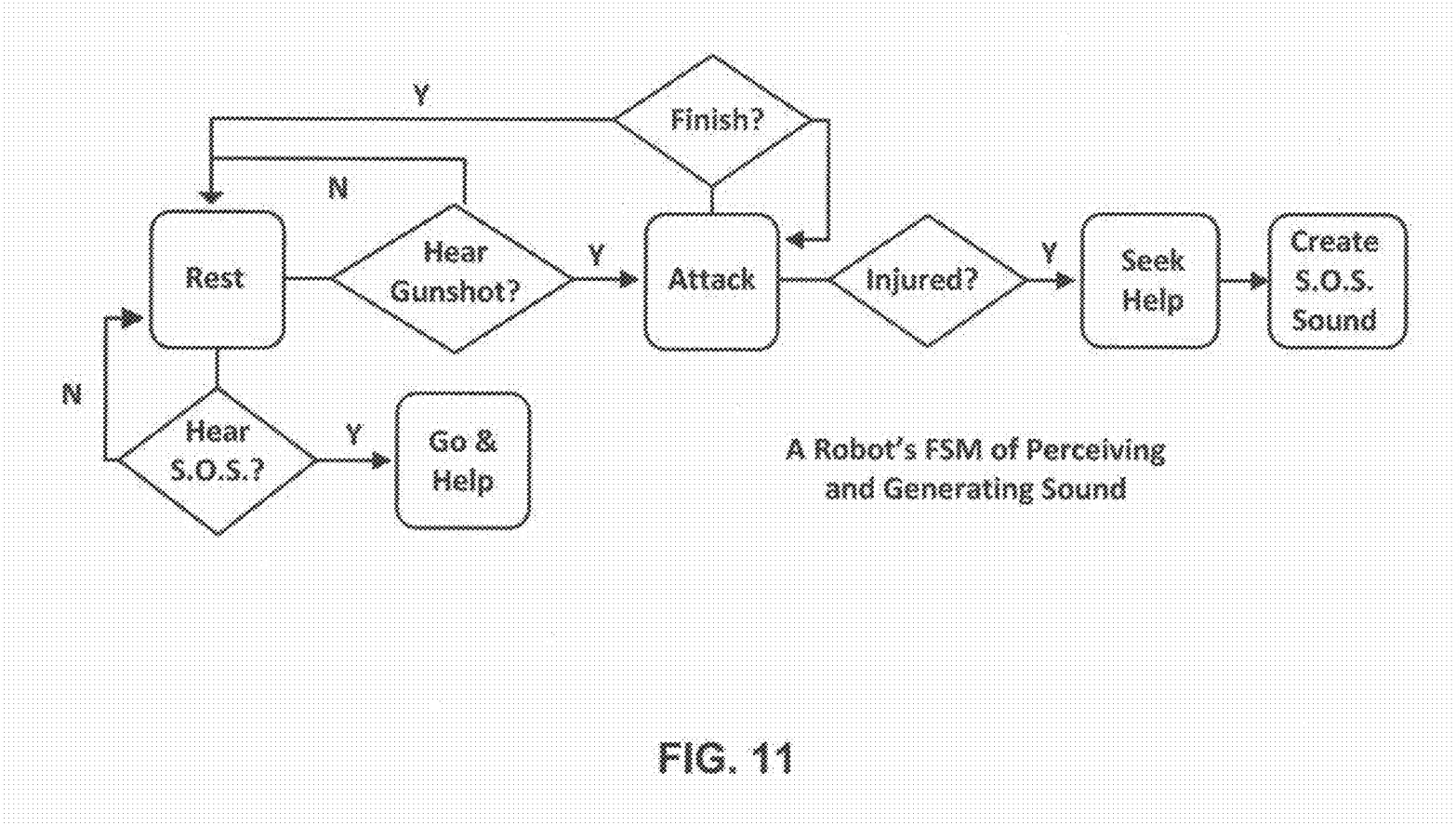
FIG. 11 illustrates a finite state machine example for modeling a robot's behavioral response to auditory triggers.

S=Σp.spreadFactor;

K=max(1, $(1-_{S/Sref})$*T) (where T=20 in current setting);

M=ComputeDTWSimilarity(D, B); $M_K$=Extract Top K Candidates from M;

C=Find the Lowest Common Ancestor of $M_K$ in the HCA Tree;

An agent's response to sound depends on being able to hear and possibly disambiguate it from noise, but it also depends on a human cognitive property: attention. A model based on two attention measures is used. The first is the amplitude threshold A=100. When any sound's total amplitude, the sum of all packets during a number of frames (≈150), exceeds this limit it will draw one's attention. Sounds which have low amplitudes are unintelligible or just contribute to nondescript background noise. The second measure computes the saliency or conspicuity of a new sound by comparing its packets with those of the previous sounds. If the difference between them is greater than a percentage threshold P=30%, it also triggers the agent's attention. These attention triggers may be used to select, modify, or terminate associated agent behaviors. FIG. 11 illustrates a simple finite-state controller for agent steering behaviors based on audio perceptions. Other agent control mechanisms are possible and can be embedded in simulations or games.

For the experiments herein, the same set of 100 environmental sound signals for a prior work was used. SPREAD using a simple virtual environment is demonstrated with static obstacles and moving agents. Global agent navigation is handled using a pre-computed navigation mesh. Static obstacles occupy grid cells with absorption and reflection rates for sound propagation. Moving agents dynamically map their absorption and reflection rates to the grid cell they presently occupy. The present discussion is regarding an example built on top of the Unity game engine which handles agent navigation or steering using RVO-based algorithms. Sound was used to change high level agent goals such as destinations; their movements are handled by Unity. Other work includes computing estimates of sound localization based on packets received and using this directional information in agent steering decisions.

Figure 12:
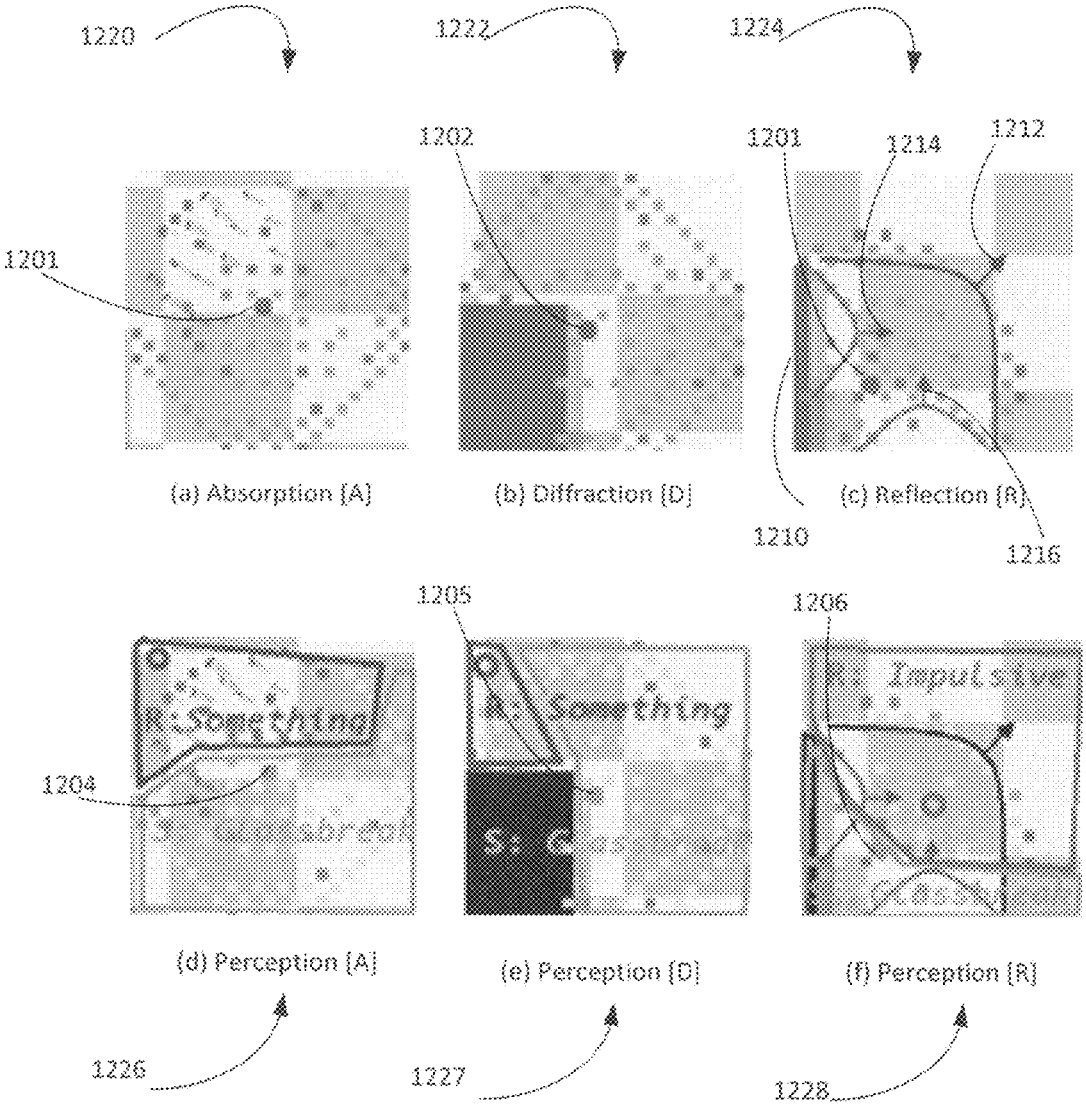
FIG. 12 illustrates TLM propagation results showcasing different acoustic properties.
Figure 13:
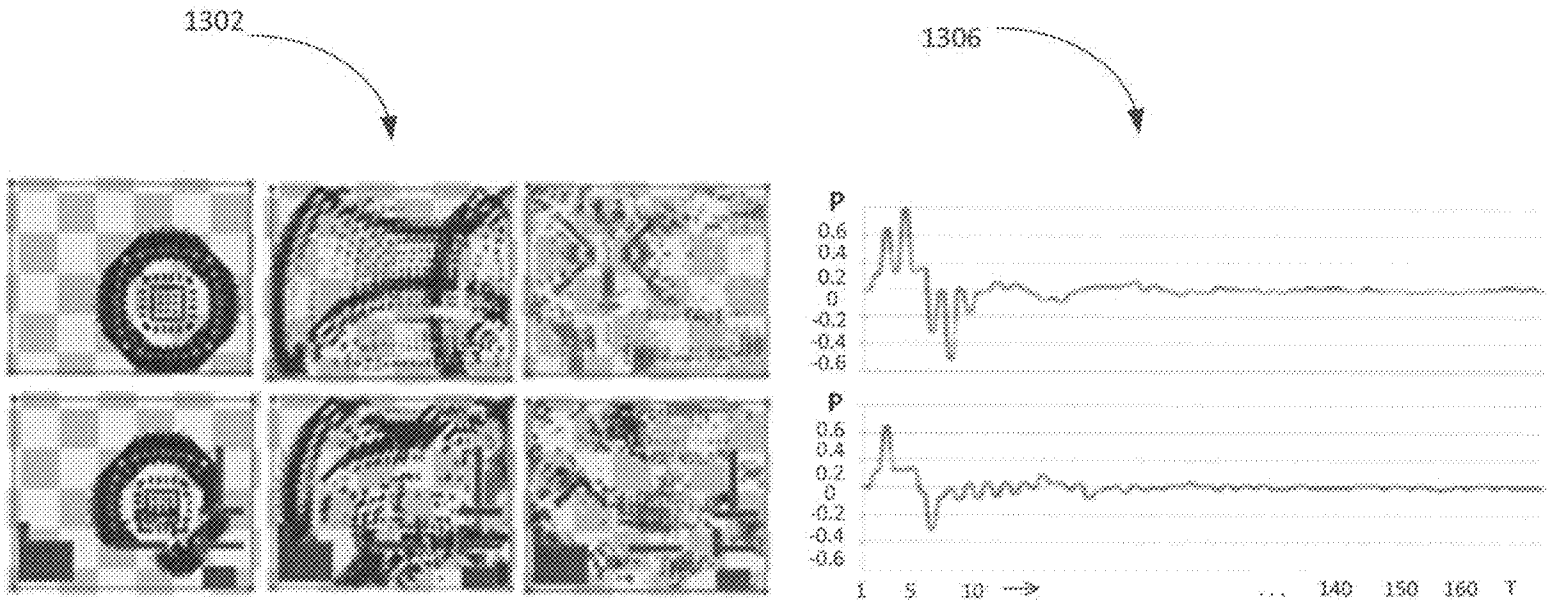
FIG. 13 illustrates a TLM comparison of different scene configurations.

FIG. 12 illustrates the different acoustic properties exhibited by the sound TLM propagation framework. All these results arise from a single omni-directional sound emission pulse at the points 1201 thru 1206 in the images. FIG. 12, at block 1220 (also referred to as (a)) shows the propagation results with absorption due to the presence of other agents. FIG. 12, at block 1222 (also referred to as (b)) illustrates diffraction of sound where the labeled automata propagates around an obstacle corner. FIG. 12, at block 1224 (also referred to as (c)) shows sound reflection where labeled automata have been bounced back from the wall 1210; arrow 1212 shows the original propagation direction, while arrow 1214 and arrow 1216 show the reflected directions. FIG. 12, at block 1226, block 1227, and block 1228 (also referred to as (d), (e), and (f)) illustrates the perception results corresponding to FIG. 12 at block 1220, block 1222, and block 1224. In FIG. 12 at block 1226, agents in the region with high absorption have approximate perception (i.e., they hear something), while agents closer by accurately perceive the glass break sound. The distortion of sound perception due to diffraction and reflection of sound are shown in FIG. 12 at block 127 and at block 1228, respectively. A result comparison is shown in FIG. 13. FIG. 13 shows the similar results from the TLM propagation and a prior work by Raghuvanshi et al.'s FDTD method on the emission of one Gaussian impulse. FIG. 13 at 1302 shows the propagation results on two different scenes of a same impulse packet. FIG. 13 at 1306 shows the impulse response packets' values sampled along time frame at the receiver (near the source). Note that this is for one frequency band.

Figure 14:
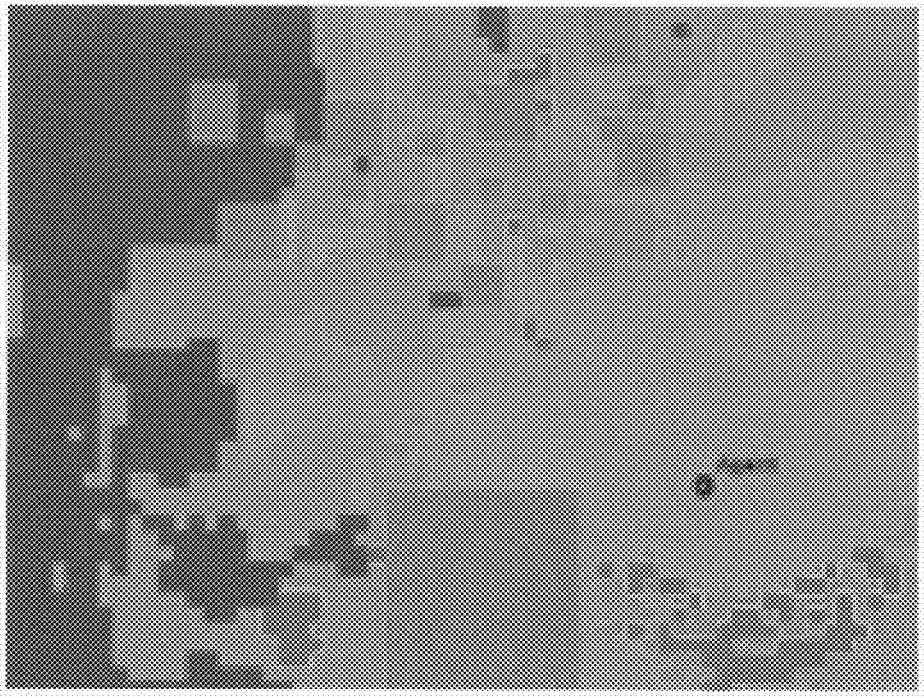
FIG. 14 illustrates a perception contour map for one agent listening to a glass break sound played at different locations in the environment with reflective obstacles.

FIG. 14 illustrates the perception contour map using the inventive approach. A perception contour map illustrates what an agent will hear when a glass break sound is played at different locations in the environment with reflective obstacles (square/rectangles). A non-linear separation is observed between regions of accurate, approximate, and incorrect perception. This is in contrast to existing models which generally use simple distance-based functions, which highlights the herein disclosed approaches veracity.

The accuracy of sound perception with respect to the sound packet representation parameters are shown in Table 1 below. In the experiment, there are 30 agents, and the sounds are played at various points and capture the agents' perceptual matches. If the perceived sound is exactly the played sound, it will increase $P_a$ which is the percentage of accurate perceptions, and if the perceived sound is an ancestor sound it will increase $P_f$ which is percentage of approximate perception. For M=1, the accuracy is very low, because adding all the spectrum values together destroys the distinct features of each frequency band. The experiments were run on a desktop PC with an Intel i7 2.8 GHz CPU, 16 GB RAM, and a Quadro NVS 420 graphics card. The system runs in real-time. The situation shown in FIG. 1 uses parameter values: M=3, N=50, #agents=20, μ=100, ν=1, ξ=1, effective length of sound data is typically about 1 s. Currently, a scene may be processed up to 150*150 grids and 50 agents in real-time, and can benefit from GPU acceleration.

TABLE 1

| | Acc. | N = 10 | N = 50 | N = N = |
|---|---|---|---|---|
| M = 1 | $P_a$ | 0.0% | 0.0% | 1.0% |
| | $P_f$ | 22.7% | 32.4% | 28.7% |
| | Ptotal | 22.7% | 32.4% | 29.7% |
| M = 3 | Pa | 19.9 | 43.5% | 38.0% |
| | Pf | 1.0% | 46.3% | 50.9% |
| | Ptotal | 20.9% | 89.8% | 88.9% |
| M = 6 | $P_a$ | 36.1% | 40.7% | 40.7% |
| | $P_f$ | 32.4% | 53.2% | 57.8% |
| | Ptotal | 68.5% | 93.9% | 98.5% |

Note that the "accurate" perception percentage is 43.5%. Since SPREAD degrades signals, it should not be expected that this be higher. This is because, here, only one (the "best") result is output, and the spread range is not considered to find a more general category for a set of candidates. Thus, even the "inaccurate" ones are still similar to the original's siblings in the HCA tree; e.g., an engine sound might degrade to a mechanical one (typically low frequency and non-periodic), but much less likely to a siren-like sound (high frequency and periodic). By considering these degraded perceptions, the algorithm used herein gives a significantly higher percentage for "accurate+approximate perception."

The benefits of SPREAD may be demonstrated by simple applications that showcase the importance of auditory triggers in interactive virtual environments. The behavior models for the autonomous virtual humans are simple state machines that serve to showcase the significant impact agent hearing can have in simulations; they can be replaced by other representations.

Figure 15:
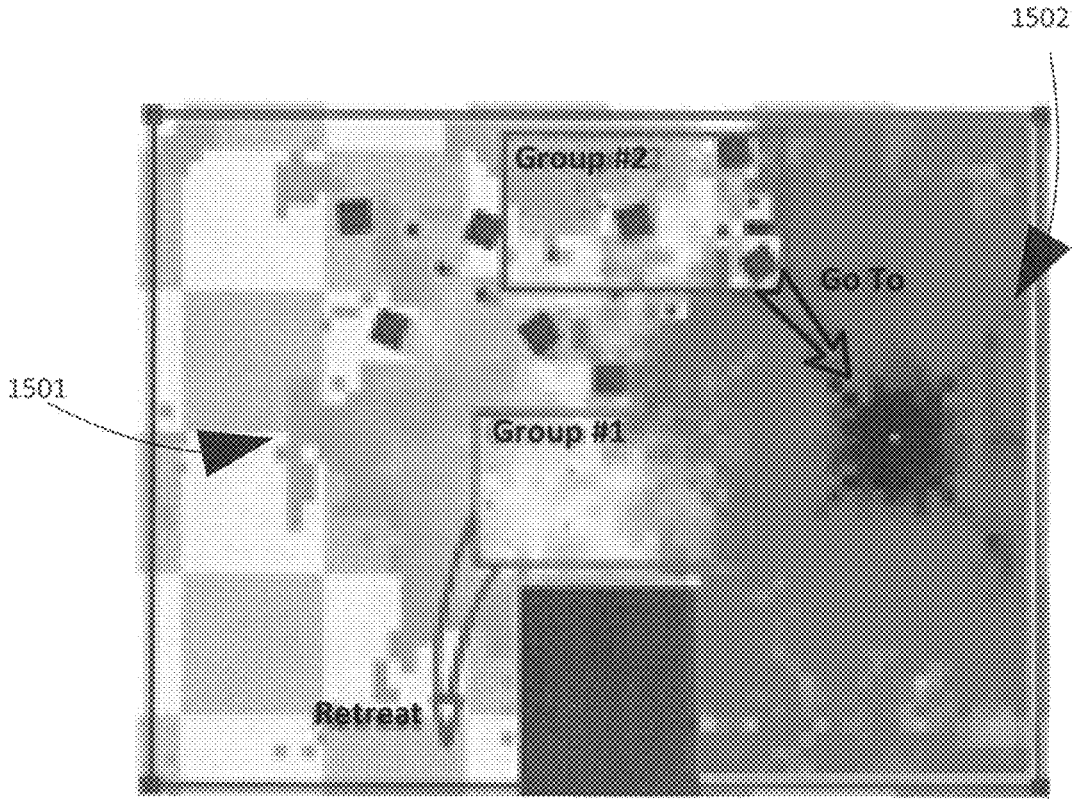
FIG. 15 illustrates sound localization.

A simple example of sound localization may be demonstrated in FIG. 15. FIG. 15 shows grid area 1502 that denote the high amplitude distribution region and area 1501 the low amplitude. Group 1 and 2 react differently by going towards the sound source or retreating from it. The sound energy distribution is calculated by summing up all the neighboring sound packets' values at all grids. Based on the energy distribution information, e.g. contours, gradients, etc., agent groups can navigate to different sound energy distribution zones in the same map. One zone goes to sound source which has higher energy value and the other zone retreats from it to the lower energy area.

Figure 16:
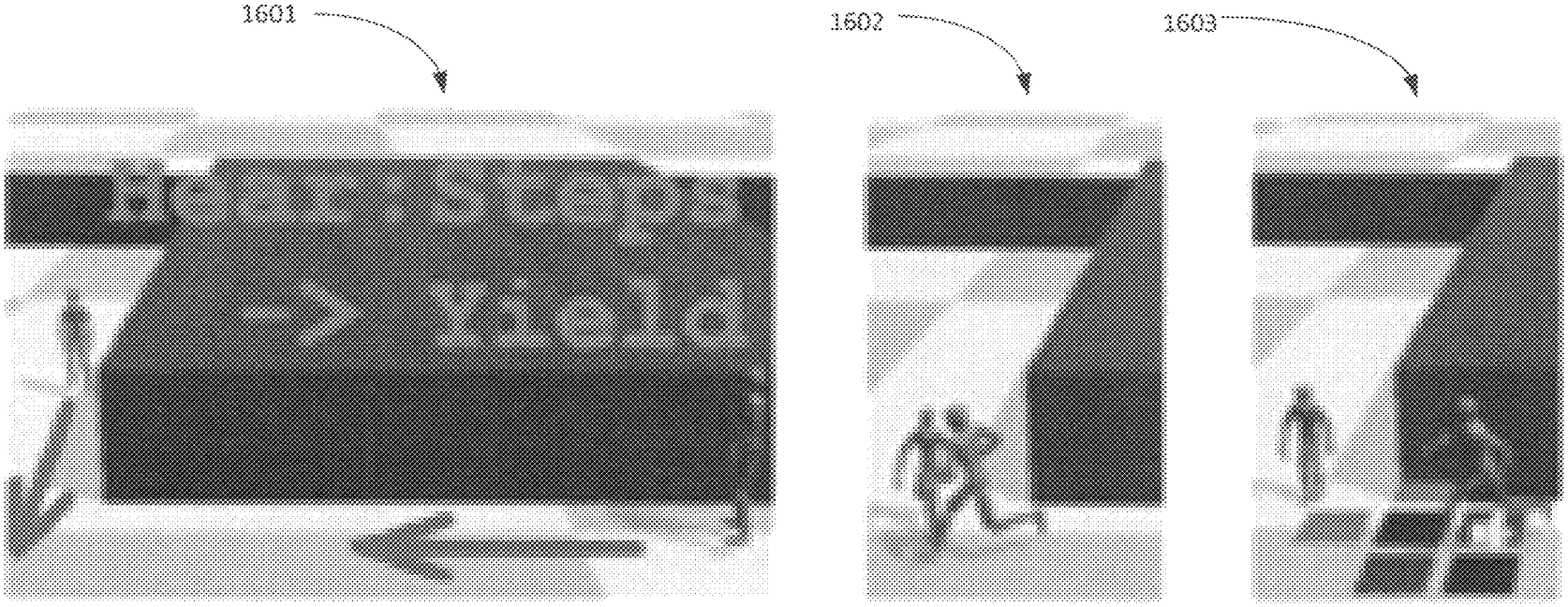
FIG. 16 illustrates blind corner reaction.

Agent actions or behaviors may be driven by their auditory perceptions. FIG. 16 illustrates an example where an agent yields to avoid a collision with another agent at a blind corner by hearing its footsteps. The supplementary video shows other results where sound triggers can be used to attract the attention of other agents, or can be mapped to directional commands to herd a crowd.

FIG. 16 at block 1601 shows agents walking toward each other at a blind corner. FIG. 16 at block 1602 shows that without sound propagation or perception modeled, agents collide with each other. FIG. 16 at block 1602 shows that with correct sound models, one agent can perceive footstep sounds and yield to the other.

The benefit of SPREAD has been demonstrated by integrating it into an experimental game application. The game may involve a player controlled avatar searching for and destroying enemy robots in a maze-like environment. The ability to perceive sounds greatly enriches a game mechanic where robots perceive and react to different sound signals in the environment. Robots hear a gunshot and retreat or attack depending on their health status. They can additionally cry out for the assistance of nearby robots by triggering a sound signal. Players can also mimic the robot cry to lure robots to an isolated location. The resulting gameplay is greatly diversified where players use a stealth based mechanic to isolate and corner robots in cordoned off areas where other robots are unable to see and hear them.

The disclosed methods and systems integrate sound propagation and human-like perception into virtual human simulations. While sound propagation and synthesis have been explored in computer graphics, and there exist extensive studies on auditory perception in psychology the new work enables virtual creatures to plausibly hear, listen, and react to auditory triggers. To achieve this goal, a minimal, yet sufficient sound representation that captures the acoustic features necessary for human perception has been developed, an efficient sound propagation framework that accurately simulates sound degradation has been designed, and hierarchical clustering analysis to model approximate human-like perceptions using sound categories is implemented.

The disclosed method serves as a companion to auralization—enabling virtual agents to hear and classify sounds much like their real human counterparts. Auralization is not a pre-requisite for this capability. The simplified SPR method may be compared with other forms of data representations for different types of sounds, as described in Cowling and Sitte 2003, *Comparison of techniques for environmental sound recognition. Pattern Recognition Letters* 24, 15, 2895-2907.

Figure 17:
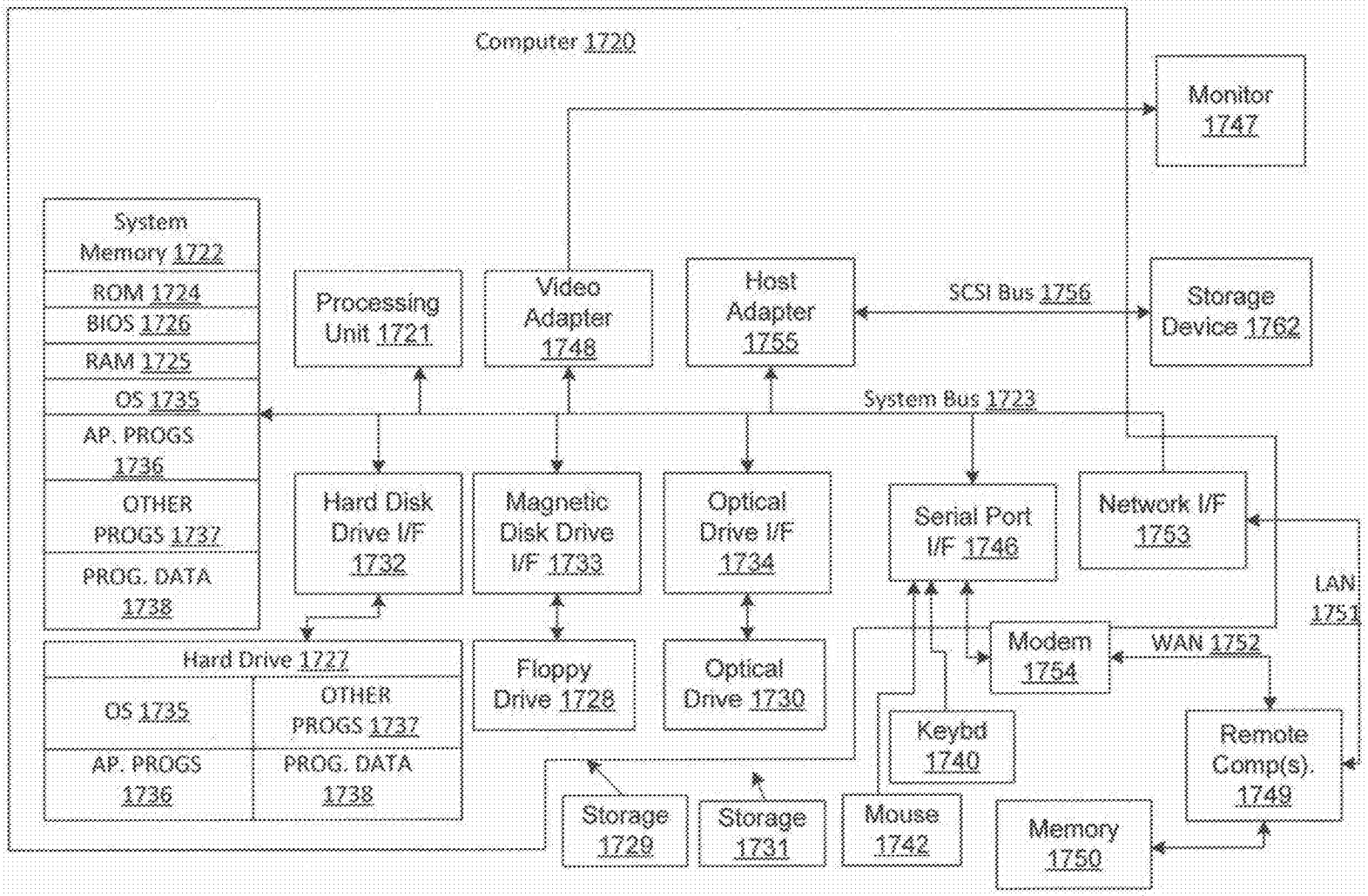
FIG. 17 is an exemplary block diagram representing a general purpose computer system in which aspects of the methods and systems disclosed herein or portions thereof may be incorporated.

FIG. 17 and the following discussion are intended to provide a brief general description of a suitable computing environment in which the methods and systems disclosed herein (such as FIG. 2A, FIG. 2B, and disclosed throughout) and/or portions thereof may be implemented. Although not required, the methods and systems disclosed herein is described in the general context of computer-executable instructions, such as program modules, being executed by a computer, such as a client workstation, server, personal computer, or mobile computing device such as a smartphone. Generally, program modules include routines, programs, objects, components, data structures and the like that perform particular tasks or implement particular abstract data types. Moreover, it should be appreciated the methods and systems disclosed herein and/or portions thereof may be practiced with other computer system configurations, including hand-held devices, multi-processor systems, microprocessor-based or programmable consumer electronics, network PCs, minicomputers, mainframe computers and the like. A processor may be implemented on a single-chip, multiple chips or multiple electrical components with different architectures. The methods and systems disclosed herein may also be practiced in distributed computing environments where tasks are performed by remote processing devices that are linked through a communications network. In a distributed computing environment, program modules may be located in both local and remote memory storage devices.

FIG. 17 is a block diagram representing a general purpose computer system in which aspects of the methods and systems disclosed herein and/or portions thereof may be incorporated. As shown, the exemplary general purpose computing system includes a computer 1720 or the like, including a processing unit 1721, a system memory 1722, and a system bus 1723 that couples various system components including the system memory to the processing unit 1721. The system bus 1723 may be any of several types of bus structures including a memory bus or memory controller, a peripheral bus, and a local bus using any of a variety of bus architectures. The system memory includes read-only memory (ROM) 1724 and random access memory (RAM) 1725. A basic input/output system 1726 (BIOS), containing the basic routines that help to transfer information between elements within the computer 1720, such as during start-up, is stored in ROM 1724.

The computer 1720 may further include a hard disk drive 1727 for reading from and writing to a hard disk (not shown), a magnetic disk drive 1728 for reading from or writing to a removable magnetic disk 1729, and an optical disk drive 1730 for reading from or writing to a removable optical disk 1731 such as a CD-ROM or other optical media. The hard disk drive 1727, magnetic disk drive 1728, and optical disk drive 1730 are connected to the system bus 1723 by a hard disk drive interface 1732, a magnetic disk drive interface 1733, and an optical drive interface 1734, respectively. The drives and their associated computer-readable media provide non-volatile storage of computer readable instructions, data structures, program modules and other data for the computer 1720. As described herein, computer-readable media is a tangible, physical, and concrete article of manufacture and thus not a signal per se.

Although the exemplary environment described herein employs a hard disk, a removable magnetic disk 1729, and a removable optical disk 1731, it should be appreciated that other types of computer readable media which can store data that is accessible by a computer may also be used in the exemplary operating environment. Such other types of media include, but are not limited to, a magnetic cassette, a flash memory card, a digital video or versatile disk, a Bernoulli cartridge, a random access memory (RAM), a read-only memory (ROM), and the like.

A number of program modules may be stored on the hard disk, magnetic disk 1729, optical disk 1731, ROM 1724 or RAM 1725, including an operating system 1735, one or more application programs 1736, other program modules 1737 and program data 1738. A user may enter commands and information into the computer 1720 through input devices such as a keyboard 1740 and pointing device 1742. Other input devices (not shown) may include a microphone, joystick, game pad, satellite disk, scanner, or the like. These and other input devices are often connected to the processing unit 1721 through a serial port interface 1746 that is coupled to the system bus, but may be connected by other interfaces, such as a parallel port, game port, or universal serial bus (USB). A monitor 1747 or other type of display device is also connected to the system bus 1723 via an interface, such as a video adapter 1748. In addition to the monitor 1747, a computer may include other peripheral output devices (not shown), such as speakers and printers. The exemplary system of FIG. 17 also includes a host adapter 1755, a Small Computer System Interface (SCSI) bus 1756, and an external storage device 1762 connected to the SCSI bus 1756.

The computer 1720 may operate in a networked environment using logical connections to one or more remote computers, such as a remote computer 1749. The remote computer 1749 may be a personal computer, a server, a router, a network PC, a peer device or other common network node, and may include many or all of the elements described above relative to the computer 1720, although only a memory storage device 1750 has been illustrated in FIG. 17. The logical connections depicted in FIG. 17 include a local area network (LAN) 1751 and a wide area network (WAN) 1752. Such networking environments are commonplace in offices, enterprise-wide computer networks, intranets, and the Internet.

When used in a LAN networking environment, the computer 1720 is connected to the LAN 1751 through a network interface or adapter 1753. When used in a WAN networking environment, the computer 1720 may include a modem 1754 or other means for establishing communications over the wide area network 1752, such as the Internet. The modem 1754, which may be internal or external, is connected to the system bus 1723 via the serial port interface 1746. In a networked environment, program modules depicted relative to the computer 1720, or portions thereof, may be stored in the remote memory storage device. It will be appreciated that the network connections shown are exemplary and other means of establishing a communications link between the computers may be used.

Computer 1720 may include a variety of computer readable storage media. Computer readable storage media can be any available media that can be accessed by computer 1720 and includes both volatile and nonvolatile media, removable and non-removable media. By way of example, and not limitation, computer readable media may comprise computer storage media and communication media. Computer storage media include both volatile and nonvolatile, removable and non-removable media implemented in any method or technology for storage of information such as computer readable instructions, data structures, program modules or other data. Computer storage media include, but are not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 1720. Combinations of any of the above should also be included within the scope of computer readable media that may be used to store source code for implementing the methods and systems described herein. Any combination of the features or elements disclosed herein may be used in one or more embodiments.

In describing preferred embodiments of SPREAD, the subject matter of the present disclosure, as illustrated in the Figures, specific terminology is employed for the sake of clarity. The claimed subject matter, however, is not intended to be limited to the specific terminology so selected, and it is to be understood that each specific element includes all technical equivalents that operate in a similar manner to accomplish a similar purpose. For example, the TLM algorithm may be extended into 3D.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed:

1. A method, comprising:

discretizing a sound signal to obtain sound packet representation packets for human-like perception;

using hierarchical clustering analysis on the sound packet representation packets to model approximate human-like perception of the sound signal; and propagating the sound packet representation packets through a virtual environment using a method that accounts for sound packet degradation.

2. The method of claim 1, further wherein the discretizing is adaptively done in a frequency and time domain.

3. The method of claim 1, wherein the sound signal is one of a plurality of sound signals from a database of short time Fourier transforms of sounds.

4. The method of claim 1, wherein the method that accounts for sound packet degradation is a transmission line matrix method.

5. The method of claim 1, wherein the propagating of the sound packet representation packets is based on a quad-tree-based pre-computation.

6. The method of claim 1, wherein the method accounts for sound packet degradation based on distance traveled.

7. The method of claim 1, wherein the method accounts for sound packet degradation based on absorption by moving agents in the virtual environment.

8. The method of claim 1, wherein the method accounts for sound packet degradation based on reflection by moving agents in the virtual environment.

9. The method of claim 1, wherein the method accounts for sound packet degradation based on absorption by obstacles in the virtual environment.

10. The method of claim 1, wherein the method accounts for sound packet degradation based on reflection by obstacles in the virtual environment.

11. A device, comprising:

a processor; and a memory coupled with the processor, the memory having stored thereon executable instructions that when executed by the processor cause the processor to effectuate operations comprising:

discretizing a sound signal to obtain sound packet representation packets for human-like perception;

using hierarchical clustering analysis on the sound packet representation packets to model approximate human-like perception of the sound signal; and propagating the sound packet representation packets through a virtual environment using a method that accounts for sound packet degradation.

12. The device of claim 11, further wherein the discretizing is adaptively done in a frequency and time domain.

13. The device of claim 11, wherein the sound signal is one of a plurality of sound signals from a database of short time Fourier transforms of sounds.

14. The device of claim 11, wherein the method that accounts for sound packet degradation is a transmission line matrix method.

15. The device of claim 11, wherein the propagating of the sound is based on a quad-tree-based pre-computation.

16. The device of claim 11, wherein the method accounts for sound packet degradation based on distance traveled.

17. The device of claim 11, wherein the method accounts for sound packet degradation based on absorption by moving agents in the virtual environment.

18. The device of claim 11, wherein the method accounts for sound packet degradation based on reflection by moving agents in the virtual environment.

19. The device of claim 11, wherein the method accounts for sound packet degradation based on absorption by obstacles in the virtual environment.

20. The device of claim 11, wherein the method accounts for sound packet degradation based on reflection by obstacles in the virtual environment.

* * * * *